US009140072B2

(12) United States Patent
Nelms et al.

(10) Patent No.: US 9,140,072 B2
(45) Date of Patent: Sep. 22, 2015

(54) CUTTING ELEMENTS INCLUDING NON-PLANAR INTERFACES, EARTH-BORING TOOLS INCLUDING SUCH CUTTING ELEMENTS, AND METHODS OF FORMING CUTTING ELEMENTS

(71) Applicant: Baker Hughes Incorporated, Houston, TX (US)

(72) Inventors: Derek L. Nelms, Tomball, TX (US); Michael L. Doster, Spring, TX (US); Jarod DeGeorge, Spring, TX (US); Danielle M. Fuselier, Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 99 days.

(21) Appl. No.: 13/780,698

(22) Filed: Feb. 28, 2013

(65) Prior Publication Data

US 2014/0238753 A1 Aug. 28, 2014

(51) Int. Cl.
*E21B 10/573* (2006.01)

(52) U.S. Cl.
CPC ..... *E21B 10/5735* (2013.01)

(58) Field of Classification Search
CPC .. E21B 10/567; E21B 10/573; E21B 10/5735
USPC ..... 175/420.1, 425, 426, 435, 428
See application file for complete search history.

(56) References Cited

U.S. PATENT DOCUMENTS 734,515 A 7/1903 Collins
1,650,492 A 11/1927 Allan
2,641,446 A 6/1953 Haglund et al.
2,707,897 A 5/1955 Beeson
2,735,656 A 2/1956 Hoglund et al.

(Continued)

FOREIGN PATENT DOCUMENTS

EP 0117506 A2 9/1984
EP 0117552 A2 9/1984

(Continued)

OTHER PUBLICATIONS

International Search Report for International Application No. PCT/US2014/019240 dated Jun. 23, 2014, 3 pages.

(Continued)

*Primary Examiner* — Elizabeth Gitlin
(74) *Attorney, Agent, or Firm* — TraskBritt

(57) ABSTRACT

Cutting elements for earth-boring tools may comprise a substrate, a polycrystalline table comprising superhard material secured to the substrate at an end of the substrate, and a non-planar interface defined between the polycrystalline table and the substrate. The non-planar interface may comprise a cross-shaped groove extending into one of the substrate and the polycrystalline table and L-shaped grooves extending into the other of the substrate and the polycrystalline table proximate corners of the cross-shaped groove. Transitions between surfaces defining the non-planar interface may be rounded. Methods of forming cutting elements for earth-boring tools may comprise forming a substrate to have a non-planar end. The non-planar end of the substrate may be provided adjacent particles of superhard material to impart an inverse shape to the particles. The particles may be sintered to form a polycrystalline table, with a non-planar interface defined between the substrate and the polycrystalline table.

20 Claims, 10 Drawing Sheets

(56) References Cited

U.S. PATENT DOCUMENTS 2,777,672 A 1/1957 Haglund et al.
2,842,342 A 7/1958 Haglund
2,888,247 A 5/1959 Haglund
3,388,757 A 6/1968 Fittinger
3,745,623 A 7/1973 Wentorf, Jr. et al.
3,913,280 A 10/1975 Hall
4,148,368 A 4/1979 Evans
4,200,159 A 4/1980 Peschel et al.
4,224,380 A 9/1980 Bovenkerk et al.
4,255,165 A 3/1981 Dennis et al.
4,311,490 A 1/1982 Bovenkerk et al.
4,353,958 A 10/1982 Kita et al.
4,412,980 A 11/1983 Tsuji et al.
4,512,426 A 4/1985 Bidegaray
4,525,179 A 6/1985 Gigl
4,538,690 A 9/1985 Short
4,539,018 A 9/1985 Whanger et al.
4,545,441 A 10/1985 Williamson
4,552,232 A 11/1985 Frear
4,554,986 A 11/1985 Jones
4,558,753 A 12/1985 Barr
4,572,722 A 2/1986 Dyer
4,592,433 A 6/1986 Dennis
4,593,777 A 6/1986 Barr
4,604,106 A 8/1986 Hall
4,605,343 A 8/1986 Hibbs et al.
4,629,373 A 12/1986 Hall
4,636,253 A 1/1987 Nakai et al.
4,640,375 A 2/1987 Barr et al.
4,664,705 A 5/1987 Horton et al.
4,679,639 A 7/1987 Barr et al.
4,686,080 A 8/1987 Hara et al.
4,690,691 A 9/1987 Komanduri et al.
4,726,432 A 2/1988 Scott et al.
4,726,718 A 2/1988 Meskin et al.
4,762,492 A 8/1988 Nagai
4,766,040 A 8/1988 Hillert et al.
4,784,023 A 11/1988 Dennis
4,797,241 A 1/1989 Peterson et al.
4,858,707 A 8/1989 Jones et al.
4,861,350 A 8/1989 Phaal et al.
4,866,885 A 9/1989 Dodsworth
4,872,520 A 10/1989 Nelson
4,907,377 A 3/1990 Csillag
4,940,180 A 7/1990 Martell
4,944,772 A 7/1990 Cho
4,976,324 A 12/1990 Tibbitts
4,981,184 A 1/1991 Knowlton et al.
4,984,642 A 1/1991 Renard et al.
4,997,049 A 3/1991 Tank et al.
5,007,207 A 4/1991 Phaal et al.
5,007,493 A 4/1991 Coolidge et al.
5,011,514 A 4/1991 Cho et al.
5,027,912 A 7/1991 Juergens
5,054,246 A 10/1991 Phaal et al.
5,061,293 A 10/1991 Barr et al.
5,078,219 A 1/1992 Morrell et al.
5,096,465 A 3/1992 Chen et al.
5,127,923 A 7/1992 Bunting et al.
5,145,017 A 9/1992 Holster et al.
5,172,778 A 12/1992 Tibbitts
5,174,374 A 12/1992 Hailey
5,217,081 A 6/1993 Waldenstrom et al.
5,222,566 A 6/1993 Taylor
5,244,039 A 9/1993 Newton
5,248,006 A 9/1993 Scott
5,279,375 A 1/1994 Tibbitts
5,314,033 A 5/1994 Tibbitts
5,332,051 A 7/1994 Knowlton
5,333,699 A 8/1994 Thigpen
5,337,844 A 8/1994 Tibbitts
5,351,769 A 10/1994 Scott et al.
5,351,772 A * 10/1994 Smith ..... 175/428
5,355,969 A 10/1994 Hardy et al.
5,364,423 A 11/1994 Bigelow et al.
5,377,773 A 1/1995 Tibbitts
5,379,853 A 1/1995 Lockwood et al.
5,379,854 A 1/1995 Dennis et al.
5,435,403 A 7/1995 Tibbitts
5,437,343 A 8/1995 Cooley et al.
5,443,337 A 8/1995 Katayama et al.
5,445,231 A 8/1995 Scott et al.
5,447,208 A 9/1995 Lund et al.
5,449,048 A 9/1995 Thigpen et al.
5,460,233 A 10/1995 Meany et al.
5,468,268 A 11/1995 Tank et al.
5,472,376 A 12/1995 Olmstead et al.
5,486,137 A 1/1996 Flood et al.
5,492,188 A 2/1996 Smith et al.
5,505,748 A 4/1996 Tank et al.
5,533,582 A 7/1996 Tibbitts
5,549,171 A 8/1996 Mensa-Wilmot et al.
5,558,170 A 9/1996 Thigpen et al.
5,560,716 A 10/1996 Tank et al.
5,564,511 A 10/1996 Frushour et al.
5,569,000 A 10/1996 Littecke et al.
5,590,729 A 1/1997 Cooley et al.
5,607,024 A 3/1997 Keith
5,641,921 A 6/1997 Dennis et al.
5,645,617 A 7/1997 Frushour et al.
5,653,300 A 8/1997 Lund et al.
5,655,612 A 8/1997 Grimes et al.
5,663,512 A 9/1997 Schader et al.
5,667,028 A 9/1997 Truax et al.
5,685,769 A 11/1997 Adia et al.
5,706,906 A 1/1998 Jurewicz et al.
5,711,702 A 1/1998 Devlin
5,722,499 A 3/1998 Nguyen et al.
5,755,298 A 5/1998 Langford et al.
5,755,299 A 5/1998 Langford et al.
5,778,994 A 7/1998 Spatz
5,848,657 A 12/1998 Flood et al.
5,855,247 A 1/1999 Scott et al.
5,871,060 A 2/1999 Jensen et al.
5,881,830 A 3/1999 Cooley
5,924,501 A 7/1999 Tibbitts
5,935,323 A 8/1999 Tanga et al.
5,944,129 A 8/1999 Jensen
5,954,147 A 9/1999 Overstreet et al.
5,957,228 A 9/1999 Yorston et al.
5,971,087 A 10/1999 Chaves
5,979,577 A 11/1999 Fielder
5,979,578 A 11/1999 Packer
5,984,005 A 11/1999 Hart et al.
5,996,713 A 12/1999 Pessier et al.
6,000,483 A 12/1999 Jurewicz et al.
6,006,846 A 12/1999 Tibbitts et al.
6,009,963 A 1/2000 Chaves et al.
6,011,232 A 1/2000 Matthias
6,026,919 A * 2/2000 Thigpen et al. ..... 175/432
6,045,440 A 4/2000 Johnson et al.
6,050,354 A 4/2000 Pessier et al.
6,053,263 A 4/2000 Meiners et al.
6,054,693 A 4/2000 Barmatz et al.
6,059,054 A 5/2000 Portwood et al.
6,065,554 A 5/2000 Taylor et al.
6,068,071 A 5/2000 Jurewicz et al.
6,068,913 A 5/2000 Cho et al.
6,082,474 A 7/2000 Matthias
6,098,730 A 8/2000 Scott et al.
6,124,564 A 9/2000 Sue et al.
6,145,608 A 11/2000 Lund et al.
6,148,937 A 11/2000 Mensa-Wilmot et al.
6,149,695 A 11/2000 Adia et al.
6,164,394 A 12/2000 Mensa-Wilmot et al.
6,167,975 B1 1/2001 Estes
6,173,797 B1 1/2001 Dykstra et al.
6,187,068 B1 2/2001 Frushour et al.
6,196,340 B1 3/2001 Jensen et al.
6,196,910 B1 3/2001 Johnson et al.
6,202,770 B1 3/2001 Jurewicz et al.
6,202,771 B1 3/2001 Scott et al.
RE37,127 E 4/2001 Schader et al.
6,216,805 B1 * 4/2001 Lays et al. ..... 175/374

(56) References Cited

U.S. PATENT DOCUMENTS 6,220,376 B1 4/2001 Lundell
6,227,319 B1 * 5/2001 Radford ..... 175/432
6,230,828 B1 5/2001 Beuershausen et al.
6,241,034 B1 6/2001 Steinke et al.
6,241,035 B1 6/2001 Portwood
6,269,894 B1 8/2001 Griffin
6,272,753 B2 8/2001 Packer
6,283,234 B1 9/2001 Torbet
6,315,067 B1 11/2001 Fielder
6,315,652 B1 11/2001 Snyder et al.
6,325,165 B1 12/2001 Eyre
6,328,117 B1 12/2001 Berzas et al.
6,344,149 B1 2/2002 Oles
6,361,873 B1 3/2002 Yong et al.
6,394,199 B1 5/2002 Skyles et al.
6,397,958 B1 6/2002 Charles et al.
6,405,814 B1 6/2002 Eyre et al.
6,408,958 B1 6/2002 Isbell et al.
6,443,248 B2 9/2002 Yong
6,447,560 B2 9/2002 Jensen et al.
6,481,511 B2 11/2002 Matthias et al.
6,488,106 B1 * 12/2002 Dourfaye ..... 175/428
6,513,608 B2 2/2003 Eyre et al.
6,524,363 B2 2/2003 Gates, Jr. et al.
6,527,065 B1 3/2003 Tibbitts et al.
6,527,069 B1 3/2003 Meiners et al.
6,544,308 B2 4/2003 Griffin et al.
6,550,556 B2 4/2003 Middlemiss et al.
6,562,462 B2 5/2003 Griffin et al.
6,564,886 B1 5/2003 Mensa-Wilmot et al.
6,571,891 B1 6/2003 Smith et al.
6,601,662 B2 8/2003 Matthias et al.
6,659,199 B2 12/2003 Swadi
6,672,406 B2 1/2004 Beuershausen
6,684,966 B2 2/2004 Lin et al.
6,719,074 B2 4/2004 Tsuda et al.
6,739,417 B2 5/2004 Smith et al.
6,779,613 B2 8/2004 Dykstra et al.
6,810,972 B2 11/2004 Sved
6,810,973 B2 11/2004 Sved
6,814,168 B2 11/2004 Sved
6,827,159 B2 12/2004 Sved
6,830,598 B1 12/2004 Sung
6,843,333 B2 1/2005 Richert et al.
D502,952 S 3/2005 Achilles et al.
6,872,356 B2 3/2005 Butcher et al.
6,883,623 B2 4/2005 McCormick et al.
6,904,983 B2 6/2005 Thigpen et al.
6,904,984 B1 6/2005 Estes et al.
6,933,049 B2 8/2005 Wan et al.
6,935,444 B2 8/2005 Lund et al.
6,962,218 B2 11/2005 Eyre
6,986,297 B2 1/2006 Scott
6,991,049 B2 1/2006 Eyre et al.
7,000,715 B2 2/2006 Sinor et al.
7,048,081 B2 5/2006 Smith et al.
7,070,635 B2 7/2006 Frushour
7,074,247 B2 7/2006 Tank et al.
7,140,448 B2 11/2006 Estes et al.
7,147,687 B2 12/2006 Mirkin et al.
7,243,745 B2 7/2007 Skeem et al.
7,261,752 B2 8/2007 Sung
7,316,279 B2 1/2008 Wiseman et al.
7,350,599 B2 4/2008 Lockwood et al.
7,350,601 B2 4/2008 Belnap et al.
7,360,608 B2 4/2008 Brackin et al.
7,363,992 B2 4/2008 Stowe et al.
7,367,875 B2 5/2008 Slutz et al.
7,368,079 B2 5/2008 Yao et al.
7,373,998 B2 5/2008 Cariveau et al.
7,377,341 B2 5/2008 Middlemiss et al.
D570,384 S * 6/2008 Morozov ..... D15/139
7,435,296 B1 10/2008 Sung
7,435,478 B2 10/2008 Keshavan
7,458,765 B2 12/2008 Stiles et al.
7,462,003 B2 12/2008 Middlemiss
7,487,849 B2 2/2009 Radtke
7,493,972 B1 * 2/2009 Schmidt et al. ..... 175/432
7,493,973 B2 2/2009 Keshavan et al.
7,497,280 B2 3/2009 Brackin et al.
7,517,589 B2 4/2009 Eyre
7,533,740 B2 5/2009 Zhang et al.
7,572,332 B2 8/2009 Gruen
7,585,342 B2 9/2009 Cho
7,608,333 B2 10/2009 Eyre
7,628,234 B2 12/2009 Middlemiss
7,647,992 B2 1/2010 Fang et al.
7,647,993 B2 1/2010 Middlemiss
7,690,589 B2 4/2010 Kerns
7,740,090 B2 6/2010 Shen et al.
7,740,673 B2 6/2010 Eyre
7,748,475 B2 7/2010 McClain et al.
7,754,333 B2 7/2010 Eyre et al.
7,757,785 B2 7/2010 Zhang et al.
7,757,790 B1 * 7/2010 Schmidt et al. ..... 175/432
7,762,355 B2 7/2010 McClain et al.
7,762,359 B1 7/2010 Miess
7,776,256 B2 8/2010 Smith et al.
7,798,257 B2 9/2010 Shen et al.
7,802,495 B2 9/2010 Oxford et al.
7,942,218 B2 5/2011 Cooley et al.
7,942,219 B2 5/2011 Keshavan et al.
7,946,363 B2 5/2011 Zhang et al.
8,016,054 B2 9/2011 Lancaster et al.
8,020,642 B2 9/2011 Lancaster et al.
8,079,428 B2 12/2011 Lyons et al.
8,087,478 B2 1/2012 Patel
8,191,656 B2 6/2012 Dourfaye et al.
8,210,288 B2 7/2012 Chen et al.
8,240,405 B2 * 8/2012 Lancaster et al. ..... 175/428
8,267,204 B2 9/2012 Lyons
8,268,452 B2 9/2012 Lyons et al.
8,277,722 B2 10/2012 Digiovanni
8,327,955 B2 12/2012 Patel
8,469,121 B2 * 6/2013 Lancaster et al. ..... 175/434
8,739,904 B2 * 6/2014 Patel ..... 175/428
2001/0003932 A1 6/2001 Packer
2003/0024351 A1 2/2003 Pender et al.
2003/0110707 A1 6/2003 Rosenflanz et al.
2003/0116361 A1 6/2003 Smith et al.
2004/0009376 A1 1/2004 Wan et al.
2004/0025443 A1 2/2004 Davies
2004/0037948 A1 2/2004 Tank et al.
2004/0049193 A1 3/2004 Capanni
2004/0140133 A1 7/2004 Liang
2004/0149493 A1 8/2004 McDonough
2004/0149495 A1 8/2004 Thigpen et al.
2004/0162014 A1 8/2004 John
2004/0163851 A1 8/2004 McDonough et al.
2005/0019114 A1 1/2005 Sung
2005/0137598 A1 6/2005 Auth
2005/0139397 A1 6/2005 Achilles et al.
2005/0247486 A1 11/2005 Zhang et al.
2005/0247491 A1 11/2005 Mirchandani et al.
2005/0247492 A1 11/2005 Shen et al.
2005/0263328 A1 12/2005 Middlemiss
2005/0269139 A1 12/2005 Shen et al.
2006/0050392 A1 3/2006 Schulz
2006/0060390 A1 3/2006 Eyre
2006/0060391 A1 3/2006 Eyre et al.
2006/0086540 A1 4/2006 Griffin et al.
2006/0113546 A1 6/2006 Sung
2006/0162967 A1 7/2006 Brackin et al.
2006/0162969 A1 7/2006 Belnap et al.
2006/0166615 A1 7/2006 Tank et al.
2006/0236616 A1 10/2006 Wan
2006/0260850 A1 11/2006 Roberts et al.
2006/0266559 A1 11/2006 Keshavan et al.
2006/0283640 A1 12/2006 Estes et al.
2007/0023206 A1 2/2007 Keshavan
2007/0029114 A1 2/2007 Middlemiss
2007/0079994 A1 4/2007 Middlemiss
2007/0102198 A1 5/2007 Oxford et al.
2007/0102199 A1 5/2007 Smith et al.

(56) References Cited

U.S. PATENT DOCUMENTS

| | | | |
|---|---|---|---|
| 2007/0102200 | A1 | 5/2007 | Choe et al. |
| 2007/0102202 | A1 | 5/2007 | Choe et al. |
| 2007/0181348 | A1 | 8/2007 | Lancaster et al. |
| 2007/0193782 | A1 | 8/2007 | Fang et al. |
| 2007/0235230 | A1 | 10/2007 | Cuillier et al. |
| 2007/0284152 | A1 | 12/2007 | Eyre et al. |
| 2008/0006448 | A1 | 1/2008 | Zhang et al. |
| 2008/0023230 | A1 | 1/2008 | Cho |
| 2008/0023231 | A1 | 1/2008 | Vail |
| 2008/0035387 | A1 | 2/2008 | Hall et al. |
| 2008/0083568 | A1 | 4/2008 | Overstreet et al. |
| 2008/0115421 | A1 | 5/2008 | Sani |
| 2008/0142267 | A1 | 6/2008 | Griffin et al. |
| 2008/0142275 | A1 | 6/2008 | Griffin et al. |
| 2008/0142276 | A1 | 6/2008 | Griffo et al. |
| 2008/0156544 | A1 | 7/2008 | Singh |
| 2008/0156545 | A1 | 7/2008 | Tibbitts |
| 2008/0178535 | A1 | 7/2008 | Wan |
| 2008/0179108 | A1 | 7/2008 | McClain et al. |
| 2008/0179109 | A1 | 7/2008 | Belnap et al. |
| 2008/0206576 | A1 | 8/2008 | Qian et al. |
| 2008/0236900 | A1 | 10/2008 | Cooley et al. |
| 2008/0264696 | A1 | 10/2008 | Dourfaye et al. |
| 2008/0283305 | A1 | 11/2008 | Overstreet et al. |
| 2008/0308276 | A1 | 12/2008 | Scott |
| 2008/0308321 | A1 | 12/2008 | Aliko |
| 2009/0022952 | A1 | 1/2009 | Keshavan |
| 2009/0022969 | A1 | 1/2009 | Zhang et al. |
| 2009/0032169 | A1 | 2/2009 | Dourfaye et al. |
| 2009/0090918 | A1 | 4/2009 | Hobart et al. |
| 2009/0114454 | A1 | 5/2009 | Belnap et al. |
| 2009/0114628 | A1 | 5/2009 | DiGiovanni |
| 2009/0127565 | A1 | 5/2009 | Sung |
| 2009/0218146 | A1 | 9/2009 | Fang et al. |
| 2009/0257942 | A1 | 10/2009 | Sung |
| 2009/0277839 | A1 | 11/2009 | Linford |
| 2009/0286352 | A1 | 11/2009 | Sung |
| 2009/0313908 | A1 | 12/2009 | Zhang et al. |
| 2010/0012389 | A1 | 1/2010 | Zhang et al. |
| 2010/0014931 | A1 | 1/2010 | Matthias |
| 2010/0068503 | A1 | 3/2010 | Neogi et al. |
| 2010/0069567 | A1 | 3/2010 | Petrov et al. |
| 2010/0084198 | A1 | 4/2010 | Durairajan et al. |
| 2010/0101866 | A1 | 4/2010 | Bird |
| 2010/0129615 | A1 | 5/2010 | Chizik et al. |
| 2010/0163310 | A1 | 7/2010 | Vempati et al. |
| 2010/0200305 | A1 | 8/2010 | Griffin et al. |
| 2010/0243334 | A1 | 9/2010 | Dourfaye et al. |
| 2010/0276200 | A1 | 11/2010 | Schwefe et al. |
| 2010/0307829 | A1 | 12/2010 | Patel |
| 2010/0326741 | A1 | 12/2010 | Patel |
| 2011/0023375 | A1 | 2/2011 | Sani et al. |
| 2011/0031036 | A1 | 2/2011 | Patel |
| 2011/0036643 | A1 | 2/2011 | Belnap et al. |
| 2011/0088954 | A1 | 4/2011 | DiGiovanni et al. |
| 2011/0155472 | A1 | 6/2011 | Lyons et al. |
| 2011/0171414 | A1 | 7/2011 | Sreshta et al. |
| 2011/0192651 | A1 | 8/2011 | Lyons et al. |
| 2011/0259642 | A1 | 10/2011 | DiGiovanni et al. |
| 2011/0315456 | A1 | 12/2011 | Lyons |
| 2012/0037431 | A1 | 2/2012 | DiGiovanni et al. |
| 2012/0056022 | A1 | 3/2012 | Lyons et al. |
| 2012/0186884 | A1 | 7/2012 | Scott et al. |
| 2012/0186885 | A1 | 7/2012 | Scott et al. |
| 2012/0222363 | A1 | 9/2012 | DiGiovanni et al. |
| 2012/0222364 | A1 | 9/2012 | Lyons et al. |
| 2012/0225253 | A1 | 9/2012 | DiGiovanni et al. |
| 2012/0225277 | A1 | 9/2012 | Scott |
| 2012/0279785 | A1 | 11/2012 | Gavia et al. |
| 2013/0000992 | A1 | 1/2013 | DiGiovanni |
| 2013/0068537 | A1 | 3/2013 | DiGiovanni |

FOREIGN PATENT DOCUMENTS

| | | | |
|---|---|---|---|
| EP | 0189212 | A1 | 7/1986 |
| EP | 0196777 | | 10/1986 |
| EP | 0236924 | A2 | 9/1987 |
| EP | 0542237 | A1 | 5/1993 |
| EP | 546725 | A1 | 6/1993 |
| EP | 0604211 | A1 | 6/1994 |
| EP | 0835981 | A1 | 4/1998 |
| EP | 0841463 | | 5/1998 |
| EP | 0852283 | A1 | 7/1998 |
| EP | 0659510 | B1 | 4/1999 |
| EP | 0918135 | A1 | 5/1999 |
| EP | 0979699 | A1 | 8/1999 |
| EP | 0941791 | A2 | 9/1999 |
| EP | 1190791 | A2 | 3/2002 |
| EP | 1330323 | B1 | 5/2006 |
| EP | 2105256 | A1 | 9/2009 |
| EP | 2147903 | A2 | 1/2010 |
| GB | 2344607 | A | 6/2000 |
| GB | 2373522 | A | 9/2002 |
| GB | 2374618 | A | 10/2002 |
| GB | 2378202 | A | 2/2003 |
| GB | 2378721 | A | 2/2003 |
| JP | 59219500 | | 12/1984 |
| JP | 61270496 | A | 11/1986 |
| JP | 05004102 | A | 1/1993 |
| JP | 2000096972 | A | 4/2000 |
| RU | 2034937 | C1 | 5/1995 |
| RU | 566439 | | 1/2000 |
| WO | 9323204 | | 11/1993 |
| WO | 9415058 | A1 | 7/1994 |
| WO | 9427769 | A1 | 12/1994 |
| WO | 9708420 | A1 | 3/1997 |
| WO | 9735091 | A1 | 9/1997 |
| WO | 9929465 | | 6/1999 |
| WO | 0020149 | A1 | 4/2000 |
| WO | 0028106 | A1 | 5/2000 |
| WO | 0034001 | A1 | 6/2000 |
| WO | 0038864 | | 6/2000 |
| WO | 0048789 | A1 | 8/2000 |
| WO | 0160554 | A1 | 8/2001 |
| WO | 0224437 | A1 | 3/2002 |
| WO | 0234437 | | 5/2002 |
| WO | 2004106004 | | 12/2004 |
| WO | 2008014003 | | 1/2008 |
| WO | 2008006010 | A3 | 5/2008 |
| WO | 2008092093 | A2 | 7/2008 |
| WO | 2008094190 | A2 | 8/2008 |
| WO | 2009118381 | A2 | 10/2009 |
| WO | 2010062419 | A2 | 6/2010 |

OTHER PUBLICATIONS

International Written Opinion for International Application No. PCT/US2014/019240 dated Jun. 23, 2014, 5 pages.

Bilen et al., U.S. Appl. No. 13/461,388 entitled, Earth-Boring Tools Having Cutting Elements with Cutting Faces Exhibiting Multiple Coefficients of Friction, and Related Methods, filed May 1, 2012.

Bilen et al., U.S. Appl. No. 61/596,433 entitled, Shaped Cutting Elements for Earth-Boring Tools, Earth-Boring Tools Including Such Cutting Elements, and Related Methods, filed Feb. 8, 2013.

Center. (n.d) The American Heritage Dictionary of the English Language, Fourth Edition. (2003). Retrieved Nov. 9, 2012 from http://www.thefreedictionary.com/center.

Chakraborty, U.S. Appl. No. 61/324,142 entitled, Method of Preparing Polycrystalline Diamond from Derivatized Nanodiamond, filed Apr. 14, 2010.

Clebosky et al., U.S. Appl. No. 13/312,576 entitled, Cutting Structures, Earth-Boring Tools Including Such Cutting Structures, and Related methods, filed Dec. 6, 2011.

Digiovanni et al., U.S. Appl. No. 13/472,377 entitled, Cutting Elements for Earth-Boring Tools, Earth-Boring Tools Including Such Cutting Elements and Related Methods, filed May 15, 2012.

Digiovanni et al., U.S. Appl. No. 13/477,905 entitled, Cutting Elements for Earth-Boring Tools, Earth-Boring Tools Including Such Cutting Elemeents, and Related Methods, filed May 22, 2012.

(56) References Cited

OTHER PUBLICATIONS

Vempati et al., U.S. Appl. No. 13/617,604 entitled, Methods of Attaching a Polycrystalline Diamond Compact to a Substrate and Cutting Elements Formed Using Such Methods, filed Sep. 14, 2012.
Digiovanni, Anthony A., U.S. Appl. No. 13/610,123 entitled, Sensor-Enabled Cutting Elements for Earth-Boring Tools, Earth-Boring Tools so Equipped, and Related Methods, filed Sep. 11, 2012.
Digiovanni, U.S. Appl. No. 61/535,772 entitled, Cutting Elements for Earth-Boring Tools, Earth-Boring Tools Including Such Cutting Elements and Related Methods, filed Sep. 16, 2011.
Guilin Color Engineered Diamond Technology (EDT) Co. Ltd., Brochure, Offshore Technology Conference Apr. 30-May 3, 2012.
Guilin Star Diamond Superhard Material Co. Ltd., Brochure, Offshore Technology Conference Apr. 30-May 3, 2012.
Pilkey in Peterson's Stress Concentration Factors (2d ed., Wiley Interscience 1997), in Section 2.6.6, on p. 71 (1997).
Richert et al., U.S. Appl. No. 13/661,605 entitled, Plow-Shaped Cutting Elements for Earth-Boring Tools, Earth-Boring Tools Including Such Cutting Elements, and Related Methods, filed Oct. 26, 2013.
Schwefe et al., U.S. Appl. No. 61/594,768 entitled, Cutting Elements Retention for High Exposure Cutting Elements on Earth Boring Tools, filed Feb. 3, 2012.
Scott, Danny E., U.S. Appl. No. 61/613,846 entitled, Self-Sharpening Cutter with Novel Substrate for Enhanced Performance and Attachment, filed Mar. 21, 2012.
Sumiya et al., Microstructure Features of Polycrystalline Diamond Synthesized Directly from Graphite Under Static High Pressure, Journal of Materials Science, vol. 39 (2004) pp. 445-450.
Sumiya et al., Synthesis of High-Purity Nano-Polycrystalline Diamond and its Characterization, SEI Technical Review, No. 59, Jan. 2005, pp. 52-59.

* cited by examiner

CUTTING ELEMENTS INCLUDING NON-PLANAR INTERFACES, EARTH-BORING TOOLS INCLUDING SUCH CUTTING ELEMENTS, AND METHODS OF FORMING CUTTING ELEMENTS

FIELD

The disclosure relates generally to cutting elements for earth-boring tools. More specifically, disclosed embodiments relate to non-planar interfaces between polycrystalline tables and substrates of cutting elements for earth-boring tools that may manage stress in regions of the polycrystalline table and interrupt crack propagation through the polycrystalline table.

BACKGROUND

Earth-boring tools for forming wellbores in subterranean earth formations may include cutting elements secured to a body. For example, fixed-cutter earth-boring rotary drill bits (also referred to as "drag bits") include cutting elements that are fixedly attached to a bit body of the drill bit. Roller cone earth-boring rotary drill bits may include cones that are mounted on bearing pins extending from legs of a bit body such that each cone is capable of rotating about the bearing pin on which it is mounted. Cutting elements may extend from each cone of the drill bit.

The cutting elements used in such earth-boring tools often include polycrystalline diamond compact (PDC) cutting elements, also termed "cutters," which are cutting elements including a polycrystalline diamond (PCD) material, which may be characterized as a superabrasive or superhard material. Such polycrystalline diamond materials are formed by sintering and bonding together relatively small synthetic, natural, or a combination of synthetic and natural diamond grains or crystals, termed "grit," under conditions of high temperature and high pressure in the presence of a catalyst, such as, for example, cobalt, iron, nickel, or alloys and mixtures thereof, to form a layer of polycrystalline diamond material, also called a diamond table. These processes are often referred to as high temperature/high pressure (HTHP) processes. The polycrystalline diamond material may be secured to a substrate, which may comprise a cermet material, i.e., a ceramic-metallic composite material, such as, for example, cobalt-cemented tungsten carbide. In some instances, the polycrystalline diamond table may be formed on the cutting element, for example, during the HTHP sintering process. In such instances, cobalt or other catalyst material in the cutting element substrate may be swept among the diamond grains or crystals during sintering and serve as a catalyst material for forming a diamond table from the diamond grains or crystals. Powdered catalyst material may also be mixed with the diamond grains or crystals prior to sintering the grains or crystals together in an HTHP process. In other methods, however, the diamond table may be formed separately from the cutting element substrate and subsequently attached thereto.

As the diamond table of the cutting element interacts with the underlying earth formation, for example by shearing or crushing, the diamond table may delaminate, spall, or otherwise fracture because of the high forces acting on the cutting element and resulting high internal stresses within the diamond table of the cutting element. Some cutting elements may include non-planar interfaces, such as, for example, grooves, depressions, indentations, and notches, formed in one of the substrate and the diamond table, with the other of the substrate and the diamond table including corresponding, mating interface features. Illustrative non-planar interface designs are disclosed in, for example, U.S. Pat. No. 6,283,234, issued Sep. 4, 2001, to Torbet, U.S. Pat. No. 6,527,069, issued Mar. 4, 2003, to Meiners et al., U.S. Pat. No. 7,243,745, issued Jul. 17, 2007, to Skeem et al., and U.S. Pat. No. 8,020,642, issued Sep. 20, 2011, to Lancaster et al., the disclosure of each of which is incorporated herein in its entirety by this reference.

BRIEF SUMMARY

In some embodiments, cutting elements for earth-boring tools may comprise a substrate, a polycrystalline table comprising superhard material secured to the substrate at an end of the substrate, and a non-planar interface defined between the polycrystalline table and the substrate. The non-planar interface may comprise a cross-shaped groove extending into one of the substrate and the polycrystalline table and L-shaped grooves extending into the other of the substrate and the polycrystalline table proximate corners of the cross-shaped groove. Transitions between surfaces defining the non-planar interface may be rounded.

In other embodiments, earth-boring tools may comprise a body and cutting elements secured to the body. At least one of the cutting elements may comprise a substrate, a polycrystalline table comprising superhard material secured to the substrate at an end of the substrate, and a non-planar interface defined between the polycrystalline table and the substrate. The non-planar interface may comprise a cross-shaped groove extending into one of the substrate and the polycrystalline table and L-shaped grooves extending into the other of the substrate and the polycrystalline table proximate corners of the cross-shaped groove. Transitions between surfaces defining the non-planar interface may be rounded.

In still other embodiments, methods of forming cutting elements for earth-boring tools may comprise forming a substrate to have a non-planar end. The non-planar end comprises a cross-shaped groove extending into the substrate and L-shaped protrusions extending from a remainder of the substrate proximate corners of the cross-shaped groove. Transitions between surfaces defining the non-planar end are shaped to be rounded. Particles of superhard material are positioned adjacent the non-planar end of the substrate in a container. The particles are sintered in a presence of a catalyst material to form a polycrystalline table secured to the substrate, with a non-planar interface being defined between the substrate and the polycrystalline table.

BRIEF DESCRIPTION OF THE DRAWINGS

While the disclosure concludes with claims particularly pointing out and distinctly claiming embodiments within the scope of the disclosure, various features and advantages of embodiments encompassed by the disclosure may be more readily ascertained from the following description when read in conjunction with the accompanying drawings, in which:

DETAILED DESCRIPTION

Figure 1:
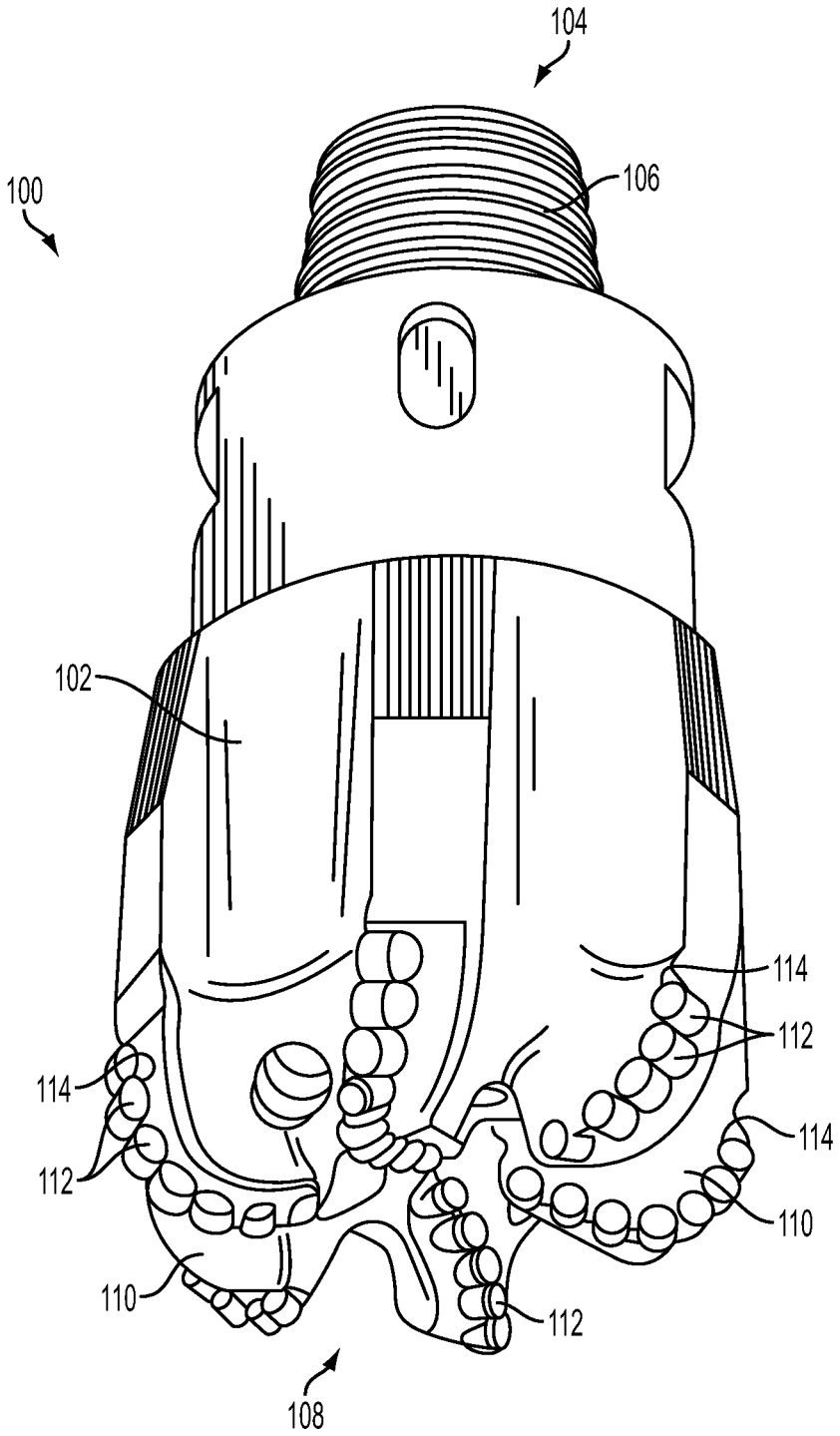
FIG. 1 is a perspective view of an earth-boring tool.

The illustrations presented herein are not meant to be actual views of any particular earth-boring tool, cutting element, non-planar interface, component thereof, or act in a method of forming such structures, but are merely idealized representations employed to describe illustrative embodiments. Thus, the drawings are not necessarily to scale.

Disclosed embodiments relate generally to non-planar interfaces between polycrystalline tables and substrates of cutting elements for earth-boring tools that may manage stress in regions of the polycrystalline table and interrupt crack propagation through the polycrystalline table. More specifically, disclosed are embodiments of non-planar interfaces that may strengthen high-stress regions within the polycrystalline table, interrupt crack propagation tending to extend circumferentially around the polycrystalline table, and reduce stress concentrations associated with conventional non-planar interface designs.

As used herein, the term "earth-boring tool" means and includes any type of bit or tool used for removing earth material during the formation or enlargement of a wellbore in a subterranean formation. For example, earth-boring tools include fixed-cutter bits, rolling cone bits, impregnated bits, percussion bits, core bits, eccentric bits, bicenter bits, mills, reamers, drag bits, hybrid bits, and other drilling bits and tools known in the art.

As used herein, the terms "polycrystalline table" and "polycrystalline material" mean and include any structure or material comprising grains (e.g., crystals) of a material (e.g., a superabrasive material) that are bonded directly together by inter-granular bonds. The crystal structures of the individual grains of the material may be randomly oriented in space within the polycrystalline table. For example, polycrystalline tables include polycrystalline diamond compacts (PDCs) characterized by diamond grains that are directly bonded to one another to form a matrix of diamond material with interstitial spaces among the diamond grains.

As used herein, the terms "inter-granular bond" and "inter-bonded" mean and include any direct atomic bond (e.g., covalent, metallic, etc.) between atoms in adjacent grains of superabrasive material.

As used herein, the term "superhard" means and includes any material having a Knoop hardness value of about 3,000 $Kg_f/mm^2$ (29,420 MPa) or more. Superhard materials include, for example, diamond and cubic boron nitride. Superhard materials may also be characterized as "superabrasive" materials.

As used herein, the phrase "substantially completely removed" when used in connection with removal of catalyst material from a polycrystalline material means and includes removal of all catalyst material accessible by known catalyst removal processes. For example, substantially completely removing catalyst material includes leaching catalyst material from all accessible interstitial spaces of a polycrystalline material by immersing the polycrystalline material in a leaching agent (e.g., aqua regia) and permitting the leaching agent to flow through the network of interconnected interstitial spaces until all accessible catalyst material has been removed. Residual catalyst material located in isolated interstitial spaces, which are not connected to the rest of the network of interstitial spaces and are not accessible without damaging or otherwise altering the polycrystalline material, may remain.

As used herein, the term "L-shaped" means and includes any shape defined by two rays extending from an intersection, wherein an angle defined by the rays is between 80° and 100°. For example, L-shapes include right angles, T-squares, perpendicular rays, and other known L-shapes.

Referring to FIG. 1, a perspective view of an earth-boring tool 100 is shown. The earth-boring tool 100 may include a body 102. An upper end 104 of the body 102 may include a connector 106 (e.g., an American Petroleum Institute (API) threaded connection) configured to connect the earth-boring tool 100 to other components of a drill string (e.g., drill pipe). A lower end 108 of the body 102, for example, may be configured to engage with an underlying earth formation. For example, the lower end 108 of the body 102 may include blades 110 extending outward from a remainder of the body 102 and extending radially over the lower end 108 of the body 102. Cutting elements 112 may be secured to the blades 110, such as, for example, by brazing the cutting elements 112 within pockets 114 formed in the blades 110, at rotationally leading faces of the blades 110. The cutting elements 112 and blades 110 may cooperatively define a cutting structure configured to engage with and remove an underlying earth formation.

Figure 2:
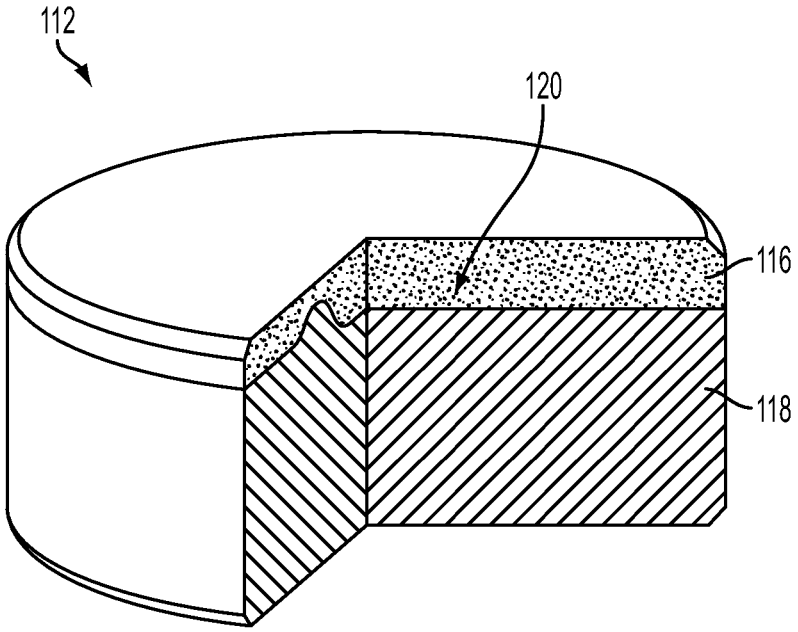
FIG. 2 is a perspective partial cross-sectional view of a cutting element of the earth-boring tool of FIG. 1.

Referring to FIG. 2, a perspective partial cross-sectional view of a cutting element 112 of the earth-boring tool 100 of FIG. 1 is shown. The cutting element 112 may include a polycrystalline table 116 of a superhard material configured to directly contact and remove earth material. The polycrystalline table 116 may comprise a generally disk-shaped structure formed from individual grains of superhard material that have interbonded to form a polycrystalline matrix of grains with interstitial spaces located among the grains. The superhard material may comprise, for example, diamond or cubic boron nitride.

The polycrystalline table 116 may be positioned on an end of a substrate 118 and secured to the substrate 118. The substrate 118 may comprise a hard material suitable for use in earth-boring applications such as, for example, a ceramic-metallic composite material (i.e., a cermet) (e.g., cemented tungsten carbide), and may be formed in a generally cylindrical shape. The polycrystalline table 116 may be secured to the substrate 118 by, for example, a continuous metal material extending into the polycrystalline table 116 and the substrate 118, such as, for example, matrix material of the substrate 118 that has infiltrated among and extends continuously into the interstitial spaces of the polycrystalline table 116. An interface 120 between the polycrystalline table 116 and the substrate 118, defined by their abutting surfaces, may be non-planar. The non-planar interface 120 of the cutting element 112 may be configured to strengthen high-stress regions within the polycrystalline table 116, interrupt crack propagation tending to extend circumferentially around the polycrystalline table 116, and reduce stress concentrations associated with conventional non-planar interface designs.

Figure 3:
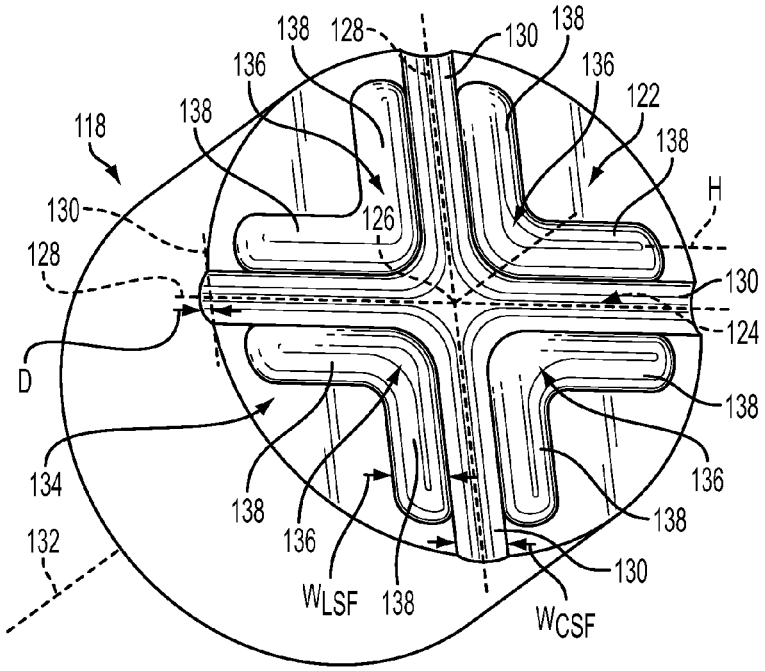
FIG. 3 is a perspective view of a substrate of the cutting element of FIG. 2.
Figure 4:
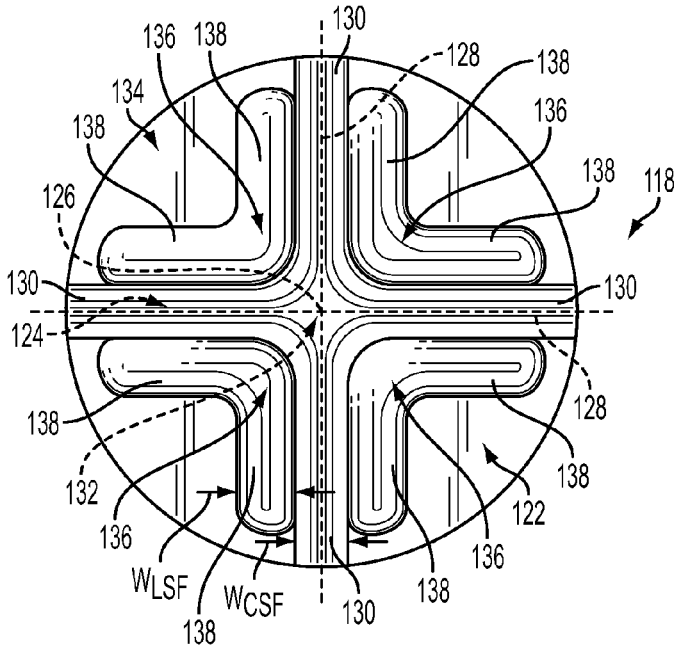
FIG. 4 is an end view of the substrate of the cutting element of FIG. 2.

Referring collectively to FIGS. 3 and 4, a perspective view and an end view of the substrate 118 of the cutting element 112 of FIG. 2 are shown. An end 122 of the substrate 118 on which the polycrystalline table 116 (see FIG. 2) will be formed or otherwise attached may be non-planar. The non-planar end 122 of the substrate 118 may include a cross-shaped (e.g., cruciform) feature 124, which is depicted as a cross-shaped groove extending into the substrate 118 in the embodiment of FIGS. 3 and 4. In other embodiments, the non-planar end 122 of the substrate 118 may comprise a cross-shaped protrusion extending away from a remainder of the substrate 118. A mating cross-shaped feature, embodied as the other of a groove or a protrusion, may be located on the polycrystalline table 116 (see FIG. 2). A center point 126 of the cross-shaped feature 124 defined at an intersection of perpendicular centerlines 128 of individual radially extending features 130 (e.g., grooves or protrusions) may be located at a central axis 132 of the substrate 118. The individual radially extending features 130 may extend to the periphery of the substrate 118, such that the planar surface 134 at the periphery is interrupted by the cross-shaped feature 124.

A depth D of the cross-shaped feature 124, as measured from a planar surface 134 at a periphery of the end 122 of the substrate 118 extending into the substrate 118 or into the polycrystalline table 116 (see FIG. 2), may be, for example, between about 0.25 mm and about 0.50 mm. As a specific, non-limiting example, the depth D of the cross-shaped feature 124 may be about 0.40 mm. The depth D of the cross-shaped feature 124 may be uniform in some embodiments. In other embodiments, the depth D of the cross-shaped feature 124 may not be constant. For example, the depth D of the cross-shaped feature may change (e.g., increase or decrease) as distance from the central axis 132 increases, which change may be constant (e.g., linear) or may vary (e.g., exponentially). A width $W_{CSF}$ of each individual radially extending feature 130 of the cross-shaped feature 124 may be, for example, between about 0.75 mm and about 1.75 mm. As a specific, non-limiting example, the width $W_{CSF}$ of each individual radially extending feature of the cross-shaped feature 124 may be about 1.25 mm. The width $W_{CSF}$ of each individual radially extending feature 130 of the cross-shaped feature 124 may be uniform in some embodiments. In other embodiments, the width $W_{CSF}$ of each individual radially extending feature 130 of the cross-shaped feature 124 may not be constant. For example, width $W_{CSF}$ of each individual radially extending feature 130 of the cross-shaped feature 124 may change (e.g., increase or decrease) as distance from the central axis 132 increases, which change may be constant (e.g., linear) or may vary (e.g., exponentially). In embodiments where the cross-shaped feature 124 comprises a cross-shaped groove extending into the substrate 118, the cross-shaped feature may strengthen the polycrystalline table 116 (see FIG. 2) in regions where the polycrystalline table 116 (see FIG. 2) is particularly susceptible to damage, such as, for example, at and around the central axis 132 of the substrate 118, which may also define a central axis of the cutting element 112 (see FIG. 2) and at the peripheral edge, by thickening the superhard material of the polycrystalline table 116 at those locations. In addition, the cross-shaped feature 124 may act as a conduit to channel stress away from the peripheral edge.

The non-planar end 122 of the substrate 118 may include L-shaped features 136 located proximate corners of the cross-shaped feature 124 in each quadrant defined by the cross-shaped feature 124, which L-shaped features 136 are depicted as L-shaped protrusions extending away from the remainder of the substrate 118 in the embodiment of FIGS. 3 and 4. In other embodiments, the non-planar end 122 of the substrate 118 may comprise L-shaped grooves extending into the substrate 118. A mating L-shaped feature, embodied as the other of a groove or a protrusion, may be located on the polycrystalline table 116 (see FIG. 2). Arms 138 of the L-shaped features 136 may not extend to the periphery of the substrate 118 such that a portion of the planar surface 134 at the periphery is uninterrupted by the L-shaped features 136.

A height H of each L-shaped feature 136, as measured from the planar surface 134 at a periphery of the end 122 of the substrate 118 extending into the substrate 118 or into the polycrystalline table 116 (see FIG. 2), may be greater than the greatest depth D of the cross-shaped feature 124. For example, the height H of each L-shaped feature 136 may be at least about 2 times, at least about 3 times, or even at least about 4 times greater than the greatest depth D of the cross-shaped feature 124. The height H of each L-shaped feature 136 may be, for example, between about 1.50 mm and about 0.50 mm. As a specific, non-limiting example, the height H of each L-shaped feature 136 may be about 1.27 mm.

A width $W_{LSF}$ of each arm 138 of the L-shaped features 136 may be greater than or equal to the greatest width $W_{CSF}$ of each radially extending feature 130 of the cross-shaped feature 124. For example, the width $W_{LSF}$ of each arm 138 of the L-shaped features 136 may be at least about 1.25 times, at least about 1.5 times, or even at least about 1.75 times greater than the greatest width $W_{CSF}$ of each radially extending feature 130 of the cross-shaped feature 124. The width $W_{LSF}$ of each arm 138 of the L-shaped features 136 may be, for example, between about 1.00 mm and about 3.00 mm. As a specific, non-limiting example, the width $W_{LSF}$ of each arm 138 of the L-shaped features 136 may be about 2.00 mm.

In embodiments where each L-shaped feature 136 comprises an L-shaped protrusion extending away from the remainder of the substrate 118, the L-shaped feature 136 may strategically weaken regions where the polycrystalline table 116 (see FIG. 2) is not particularly susceptible to damage, such as, for example, in intermediate regions between the periphery and center of the cutting element 112 (see FIG. 2), by thinning the polycrystalline table 116 (see FIG. 2) at those locations. In addition, the L-shaped features 136 may interrupt crack propagation through the polycrystalline table 116 (see FIG. 2) such that the likelihood that cracks propagate to complete an entire circle within the polycrystalline table 116 (see FIG. 2) may be reduced, which may reduce the occurrence of spalling of the polycrystalline table 116 (see FIG. 2).

Transitions between surfaces defining the non-planar end 122 of the substrate 118 may be rounded. For example, a radius of curvature of each transition between surfaces defining the non-planar end 122 may be about 0.5 times the depth D of the cross-shaped feature 124 or greater. More specifically, the radius of curvature of each transition between surfaces defining the non-planar end 122 may be at least about 0.75 times the depth D of the cross-shaped feature 124, at least equal to the depth D of the cross-shaped feature 124, or at least 1.25 times the depth D of the cross-shaped feature 124. The radius of curvature of each transition between surfaces defining the non-planar end 122 may be, for example, at least about 0.25 mm. As a specific, non-limiting example, radiuses of curvature of each transition between surfaces defining the non-planar end 122 may be about 0.6 mm. In some embodiments, different transitions between different surfaces defining the non-planar end 122 (e.g., between the planar surface 134 and the L-shaped features 136, and between the L-shaped features 136 and the cross-shaped feature 124, between surfaces of each individual L-shaped feature 136 or of each cross-shaped feature 124) may exhibit different radiuses of curvature. In other embodiments, each transition may have the same radius of curvature. Because the features 124 and 136 described herein are curved, the location at which one feature 124 or 136 ends and another 124 or 136 begins may not be readily visible. Accordingly, the height H, depth D, and widths $W_{CSF}$ and $W_{LSF}$ described previously herein are to be measured from a point where the feature 124 or 136 intersects with the elevation of the planar surface 134. By making all transitions rounded, the non-planar interface 120 (see FIG. 2) may exhibit reduced stress concentrations as compared to conventional non-planar interfaces.

Figure 5:
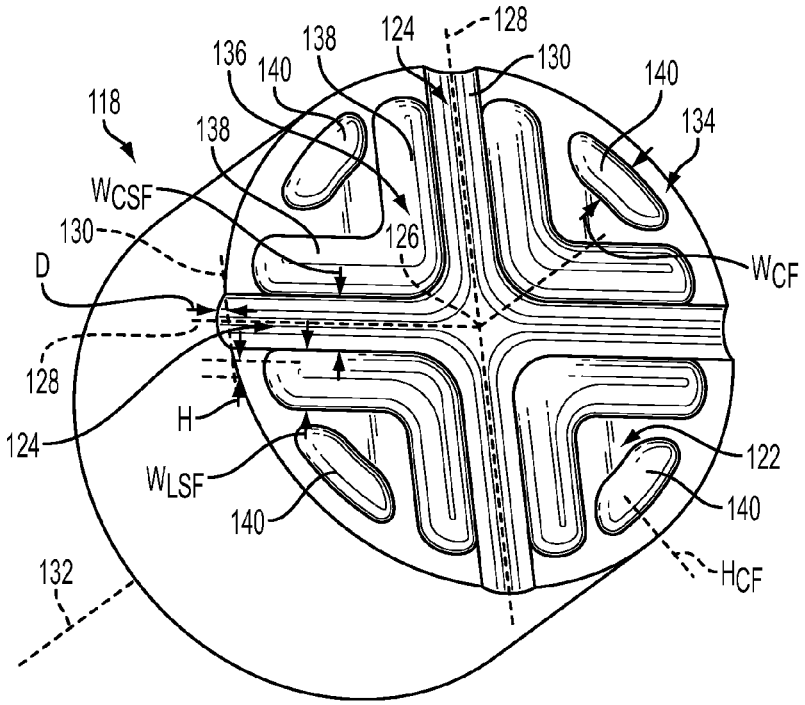
FIG. 5 is a perspective view of another embodiment of a substrate for a cutting element.
Figure 6:
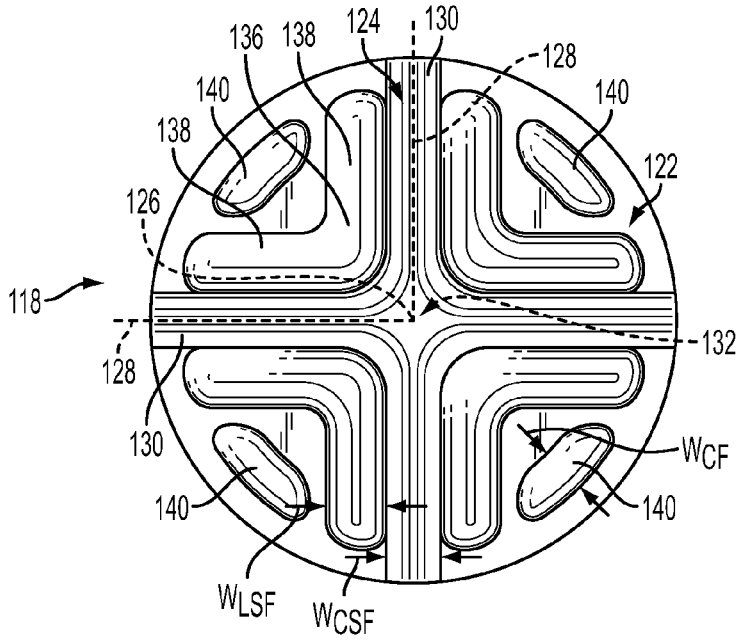
FIG. 6 is an end view of the substrate of FIG. 5.

Referring collectively to FIGS. 5 and 6, a perspective view and an end view of another embodiment of a substrate 118 for a cutting element 112 (see FIG. 2) are shown. The non-planar end 122 of the substrate 118 may include all the features 124 and 136 described previously in connection with FIGS. 3 and 4. In addition, the non-planar end 122 may include a curved feature 140 in each quadrant defined by the L-shaped features 136. For example, the curved feature 140 is depicted as a curved protrusion extending from a remainder of the substrate 118 in the embodiment of FIGS. 5 and 6. In other embodiments, the curved feature 140 may be a curved groove extending into the substrate 118. A mating curved feature, embodied as the other of a groove or a protrusion, may be located on the polycrystalline table 116 (see FIG. 2). The curved feature 140 may extend between the arms 138 of each of the L-shaped features 136, with a center of curvature of each curved feature 140 being located at the central axis 132 of the substrate 118, which may also define the central axis of the cutting element 112 (see FIG. 2). None of the curved features 140 may intersect with the arms 138 of the L-shaped features 136, such that a portion of the planar surface 134 may be interposed between each curved feature 140 and adjacent arms 138 of the L-shaped features 136. Radially outermost portions of each curved feature 140 may be located at the same radial position of, or radially closer to the central axis 132 than, radially outermost portions of the L-shaped features 136. For example, a circle defined by connecting radially outermost points of the arms 138 of each L-shaped feature 136 may also define an outermost extent of each curved feature 140.

A width $W_{CF}$ of each curved feature 140 may be less than or equal to the greatest width $W_{CSF}$ of the radially extending features 130 of the cross-shaped feature 124. For example, the width $W_{CF}$ of each curved feature 136 may be about 1.0 time or less, about 0.75 times or less, or about 0.5 times or less than the greatest width $W_{CSF}$ of the radially extending features 130 of the cross-shaped feature 124. The width $W_{CF}$ of each curved feature 140 may be, for example, between about 1.25 mm and about 0.50 mm. As a specific, non-limiting example, the width $W_{CF}$ of each curved feature 136 may be about 0.75 mm. A height $H_{CF}$ of each curved feature 140, as measured from the planar surface 134 at the periphery of the end 122 of the substrate 118 extending into the substrate 118 or into the polycrystalline table 116 (see FIG. 2), may be less than or equal to the height H of each L-shaped feature 136. For example, the height $H_{CF}$ of each curved feature 140 may be about 1.0 time or less, about 0.75 times or less, or about 0.50 times or less than the height H of each L-shaped feature 136. The height $H_{CF}$ of each curved feature 140 may be, for example, between about 1.25 mm and about 0.50 mm. As a specific, non-limiting example, the height $H_{CF}$ of each curved feature 140 may be about 1.00 mm. The curved features 140 may interrupt crack propagation within the polycrystalline table 116 (see FIG. 2) and strategically weaken the polycrystalline table 116 (see FIG. 2) to channel stress away from critical regions of the polycrystalline table 116 (see FIG. 2), such as, for example, the peripheral edge.

Figure 7:
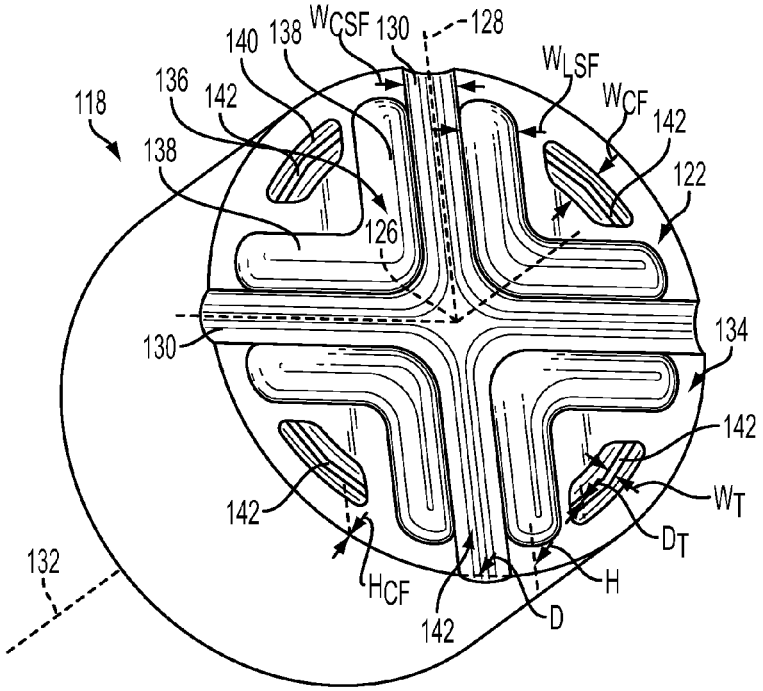
FIG. 7 is a perspective view of another embodiment of a substrate for a cutting element.
Figure 8:
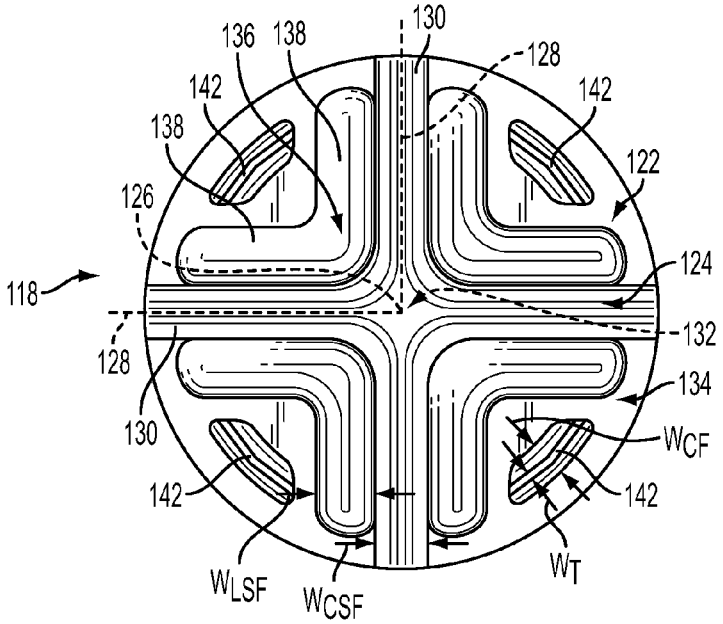
FIG. 8 is an end view of the substrate of FIG. 7.

Referring collectively to FIGS. 7 and 8, a perspective view and an end view of another embodiment of a substrate 118 for a cutting element 112 (see FIG. 2) are shown. The non-planar end 122 of the substrate 118 may include all the features 124, 136, and 140 described previously in connection with FIGS. 5 and 6. In addition, the non-planar end 122 may include a trench 142 formed in each curved feature 140. For example, the trench 142 is depicted as a extending into the substrate 118 in the embodiment of FIGS. 5 and 6. In other embodiments, the trench 142 extend away from the substrate 118. A mating trench, embodied as the other of a extending away from or into the polycrystalline table 116 (see FIG. 2), may be located on the polycrystalline table 116 (see FIG. 2). Each trench 142 may extend for an entire length of each curved feature 140, with each trench 142 following the curve of an associated curved feature 140. For example, a center of curvature of each trench 142 may be located at the central axis 132 of the substrate 118, which may also define the central axis of the cutting element 112 (see FIG. 2). Each trench 142 may be centrally located on its associated curved feature 140, such that the curved feature 140 extends radially an equal distance from each of the radially innermost and radially outermost portion of the trench 142.

A width $W_T$ of each trench 142 may be less than the width $W_{CF}$ of its associated curved feature 140. For example, the width $W_T$ of each trench 142 may be about 0.5 times or less, about 0.25 times or less, or about 0.125 times or less than the width $W_{CF}$ of its associated curved feature 140. The width $W_T$ of each trench 142 may be, for example, between about 0.75 mm and about 0.12 mm. As a specific, non-limiting example, the width $W_T$ of each trench 142 may be about 0.25 mm. A depth $D_T$ of each trench 142, as measured from an uppermost point on its associated curved feature 140 extending into or away from the curved feature 140, may be less than or equal to the height $H_{CF}$ of the associated curved feature 140. For example, the depth $D_T$ of each trench 142 may be about 0.75 times or less, or about 0.50 times or less, or about 0.25 times or less than the height $H_{CF}$ of each associated curved feature 140. The depth $D_T$ of each curved feature 140 may be, for example, between about 0.75 mm and about 0.25 mm. As a specific, non-limiting example, the depth $D_T$ of each trench 142 may be about 0.50 mm. The trenches 142 may interrupt crack propagation within the polycrystalline table 116 (see FIG. 2) and channel stress away from critical regions of the polycrystalline table 116 (see FIG. 2), such as, for example, the peripheral edge.

Figure 9:
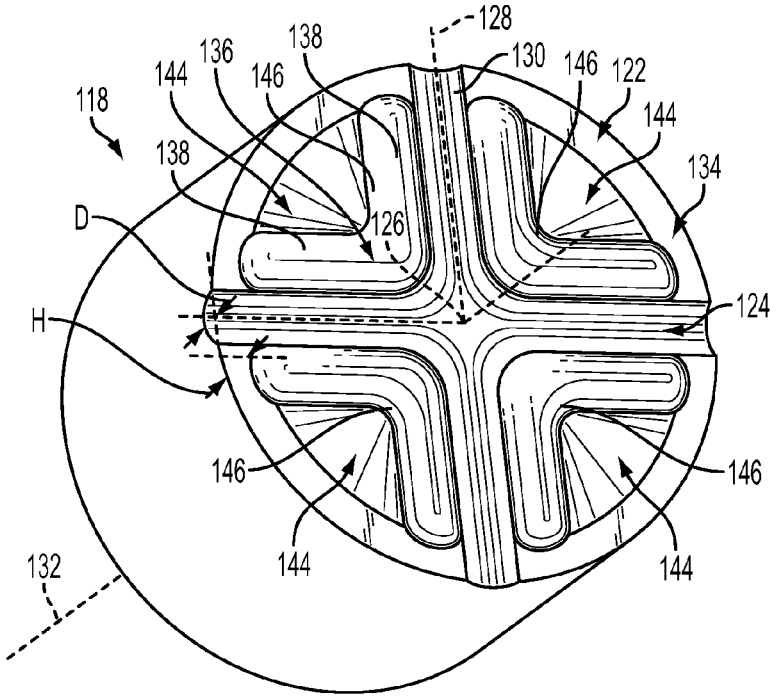
FIG. 9 is a perspective view of another embodiment of a substrate for a cutting element.
Figure 10:
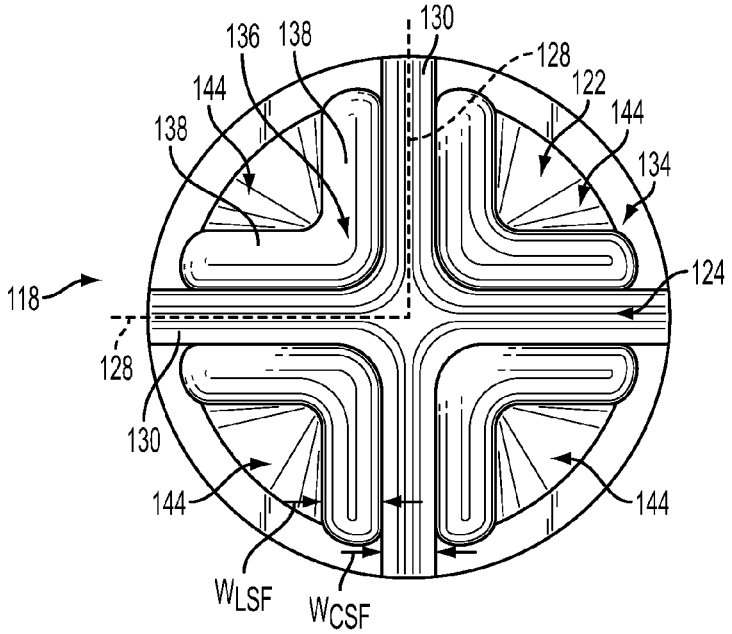
FIG. 10 is an end view of the substrate of FIG. 9.

Referring collectively to FIGS. 9 and 10, a perspective view and an end view of another embodiment of a substrate 118 for a cutting element 112 are shown. The non-planar end 122 of the substrate 118 may include all the features 124 and 136 described previously in connection with FIGS. 3 and 4. In addition, the non-planar end 122 may include a tapered surface 144 in an area between the arms 138 of each of the L-shaped features 136, extending from an intersect point 146 of each of the L-shaped features toward the one of the substrate 118 and the polycrystalline table 116 (see FIG. 2). For example, the tapered surface 144 is depicted as extending from an intersect point 146 positioned at the radially outermost location of intersection of the two arms 138 at maximum height H above the planar surface 134 toward the remainder of the substrate 118. In other embodiments, the tapered surface 144 may extend toward the polycrystalline table 116 and may extend from an intersect point defined by other features of the arms 138 (e.g., centerlines, radially innermost portion at maximum height H, midway to maximum height H, etc.). The tapered surface 144 may intersect with the arms 138 of the L-shaped features 136 along their length, such that no portion of the planar surface 134 is interposed between each tapered surface 144 and adjacent arms 138 of the L-shaped features 136 and the gradual taper of the tapered surface 144 is visible as compared to a more abrupt transition to the maximum height H of each L-shaped feature 136. Radially outermost portions of each tapered surface may be located at the same radial position of, or radially closer to the central axis 132 than, radially outermost portions of the L-shaped features 136. For example, a circle defined by connecting radially outermost points of the arms 138 of each L-shaped feature 136 may also define an outermost extent of each tapered surface 144.

A slope of each tapered surface 144 may be less than or equal to the height H of each L-shaped feature 136 divided by the length of an arm 138 of each L-shaped feature. For example, the slope of each tapered surface 144 may be less than or equal to the height H of each L-shaped feature 136 divided by the length of an arm 138 as measured from a radially outermost point of the arm 138 at an elevation of the planar surface 134 to a radially innermost point of the arm 138 at the elevation of the planar surface 134. The slope of each tapered surface 144 may be, for example, between about 0.50 and about 0.10. As a specific, non-limiting example, the slope of each tapered surface 144 may be about 0.30. The sloped surfaces 144 may strategically weaken the polycrystalline table 116 (see FIG. 2) to channel stress away from critical regions of the polycrystalline table 116 (see FIG. 2), such as, for example, the peripheral edge.

Figure 11:
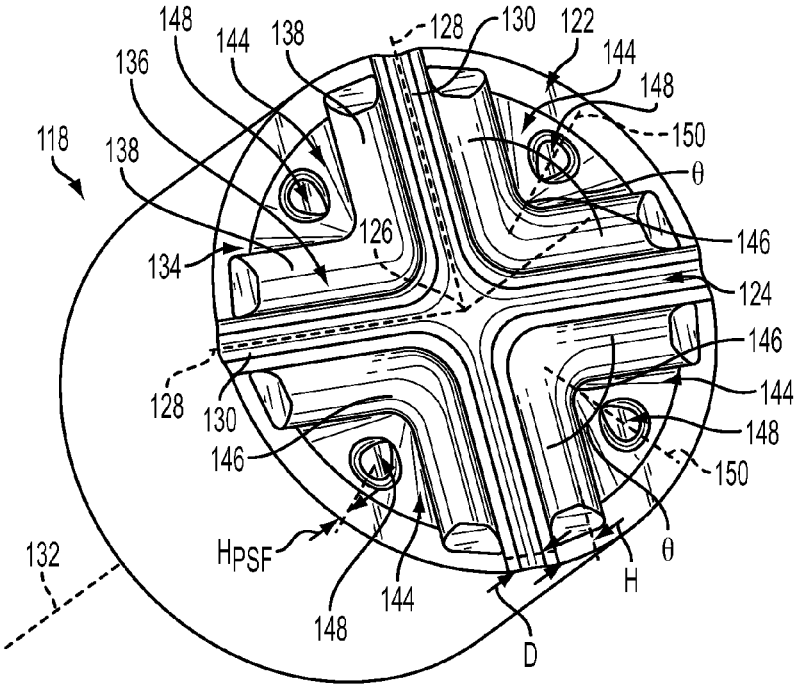
FIG. 11 is a perspective view of another embodiment of a substrate for a cutting element.
Figure 12:
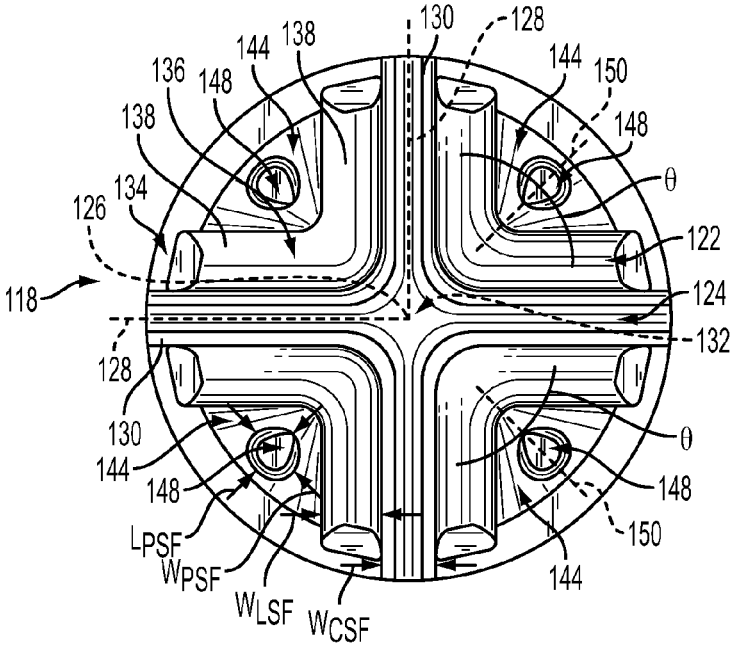
FIG. 12 is an end view of the substrate of FIG. 11.

Referring collectively to FIGS. 11 and 12, a perspective view and an end view of another embodiment of a substrate 118 for a cutting element 112 are shown. The non-planar end 122 of the substrate 118 may include all the features 124, 136, and 140 described previously in connection with FIGS. 9 and 10. In addition, the non-planar end 122 may include a pear-shaped feature 148 in each quadrant defined by the L-shaped features 136. For example, the pear-shaped feature 148 is depicted as a pear-shaped protrusion extending from the tapered surface 144 in the embodiment of FIGS. 11 and 12. In other embodiments, the curved feature 140 may be a pear-shaped depression extending into the tapered surface 144. A mating pear-shaped feature, embodied as the other of a depression or a protrusion, may be located on the polycrystalline table 116 (see FIG. 2). An axis of symmetry 150 of each pear-shaped feature 148 may bisect an angle θ defined between the arms 138 of each of the L-shaped features 136. Radially outermost portions of each pear-shaped feature 148 may be located radially closer to the central axis 132 than radially outermost portions of the tapered surface 144. For example, the distance between a radially innermost portion of each pear-shaped feature 148 and the intersect point 146 described previously in connection with FIGS. 9 and 10 may be equal to the shortest distance between a radially outermost portion of each pear-shaped feature 148 and the radially outermost portion of the tapered surface 144.

A greatest width $W_{PSF}$ of each pear-shaped feature 148 taken in a direction perpendicular to the axis of symmetry 150 of a respective pear-shaped feature 148 may be less than or equal to the greatest width $W_{CSF}$ of the radially extending features 130 of the cross-shaped feature 124. For example, the greatest width $W_{PSF}$ of each pear-shaped feature 148 may be about 1.0 time or less, about 0.75 times or less, or about 0.5 times or less than the greatest width $W_{CSF}$ of the radially extending features 130 of the cross-shaped feature 124. The greatest width $W_{PSF}$ of each pear-shaped feature 148 may be, for example, between about 1.25 mm and about 0.50 mm. As a specific, non-limiting example, the greatest width $W_{PSF}$ of each pear-shaped feature 148 may be about 0.75 mm. A length $L_{CF}$ of each pear-shaped feature 148 taken in a direction parallel to the axis of symmetry 150 of a respective pear-shaped feature 148 may be greater than or equal to the greatest width $W_{PSF}$ of the pear-shaped feature 148. For example, a length $L_{PSF}$ of each pear-shaped feature 148 may be about 1.0 time or greater, about 1.1 times the greater, or about 1.25 times or greater than the greatest width $W_{PSF}$ of the pear-shaped feature 148. The length $L_{PSF}$ of each pear-shaped feature 148 may be, for example, between about 1.50 mm and about 0.50 mm. As a specific, non-limiting example, the length $L_{PSF}$ of each pear-shaped feature 148 may be about 1.00 mm. A height $H_{PSF}$ of each pear-shaped feature 148, as measured from the planar surface 134 at the periphery of the end 122 of the substrate 118 extending into the substrate 118 or into the polycrystalline table 116 (see FIG. 2), may be less than or equal to the height H of each L-shaped feature 136. For example, the height $H_{PSF}$ of each pear-shaped feature 148 may be about 1.0 time or less, about 0.75 times or less, or about 0.50 times or less than the height H of each L-shaped feature 136. The height $H_{PSF}$ of each curved feature 148 may be, for example, between about 1.25 mm and about 0.50 mm. As a specific, non-limiting example, the height $H_{PSF}$ of each curved feature 148 may be about 1.00 mm. The pear-shaped features 148 may interrupt crack propagation within the polycrystalline table 116 (see FIG. 2) and strategically weaken the polycrystalline table 116 (see FIG. 2) to channel stress away from critical regions of the polycrystalline table 116 (see FIG. 2), such as, for example, the peripheral edge.

Figure 13:
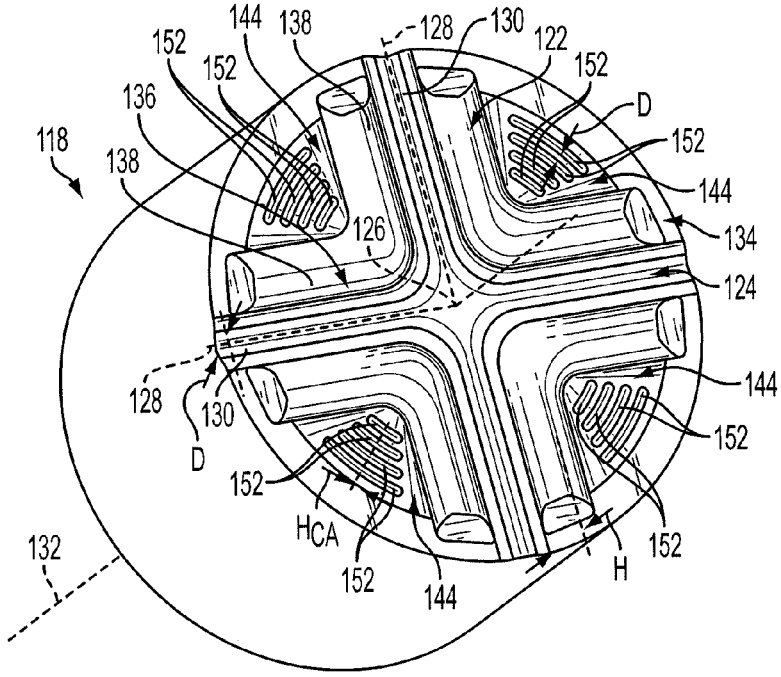
FIG. 13 is a perspective view of another embodiment of a substrate for a cutting element.
Figure 14:
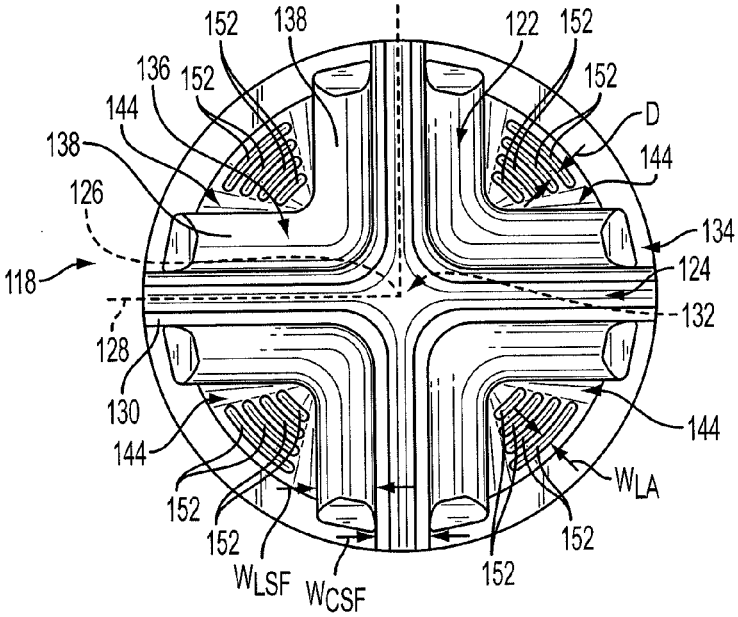
FIG. 14 is an end view of the substrate of FIG. 13.

Referring collectively to FIGS. 13 and 14, a perspective view and an end view of another embodiment of a substrate 118 for a cutting element 112 are shown. The non-planar end 122 of the substrate 118 may include all the features 124, 136, and 140 described previously in connection with FIGS. 9 and 10. In addition, the non-planar end 122 may include concentric arcs 152 in each quadrant defined by the L-shaped features 136. For example, the concentric arcs 152 are depicted as concentric arc-shaped protrusions extending from the tapered surface 144 in the embodiment of FIGS. 13 and 14. In other embodiments, the concentric arcs 152 may be a concentric arc-shaped grooves extending into the tapered surface 144. Mating concentric arcs, embodied as the other of a groove or a protrusion, may be located on the polycrystalline table 116 (see FIG. 2). The concentric arcs 152 may extend between the arms 138 of each of the L-shaped features 136, with a center of curvature of each concentric arc 152 being located at the central axis 132 of the substrate 118, which may also define the central axis of the cutting element 112 (see FIG. 2). None of the concentric arcs 152 may intersect with the arms 138 of the L-shaped features 136, such that a portion of the tapered surface 144 may be interposed between each concentric arc 152 and adjacent arms 138 of the L-shaped features 136. Radially outermost portions of radially outermost concentric arcs 152 may be located radially closer to the central axis 132 than radially outermost portions of the L-shaped features 136. For example, a circle defined by connecting radially outermost points of the arms 138 of each L-shaped feature 136 may be located radially outward from the radially outermost portions of radially outermost concentric arcs 152.

A width $W_{CA}$ of each concentric arc 152 may be less than the greatest width $W_{CSF}$ of the radially extending features 130 of the cross-shaped feature 124. For example, the width $W_{CA}$ of each concentric arc 152 may be about 0.50 times or less, about 0.25 times or less, or about 0.125 times or less than the greatest width $W_{CSF}$ of the radially extending features 130 of the cross-shaped feature 124. The width $W_{CA}$ of each concentric arc may be, for example, between about 0.75 mm and about 0.10 mm. As a specific, non-limiting example, the width $W_{CA}$ of each concentric arc 152 may be about 0.25 mm. A height $H_{CA}$ of each concentric arc 152, as measured from the tapered surface 144 extending into the substrate 118 or into the polycrystalline table 116 (see FIG. 2) may be sufficiently small that the concentric arcs 152 do not extend above any L-shaped feature 136. For example, the height $H_{CA}$ of each concentric arc 152 may be between about 0.50 mm and about 0.10 mm. As a specific, non-limiting example, the height $H_{CA}$ of each concentric arc 152 may be about 0.25 mm. A distance D between adjacent concentric arcs 152 may be greater than or equal to the height $H_{CA}$ of each concentric arc 152. For example, the distance D between adjacent concentric arcs 152 may be 1.0 times or greater, 1.25 times or greater, or 1.5 times or greater than the height HCA of each concentric arc 152. The distance D between adjacent concentric arcs 152 may be, for example, between about 0.75 mm and about 0.25 mm. As a specific, non-limiting example, the distance D between adjacent concentric arcs 152 may be about 0.50 mm. A number of arcs may be between about three and about six. For example, the number of arcs may be about four. The concentric arcs 152 may interrupt crack propagation within the polycrystalline table 116 (see FIG. 2) and strategically weaken the polycrystalline table 116 (see FIG. 2) to channel stress away from critical regions of the polycrystalline table 116 (see FIG. 2), such as, for example, the peripheral edge.

Figure 15:
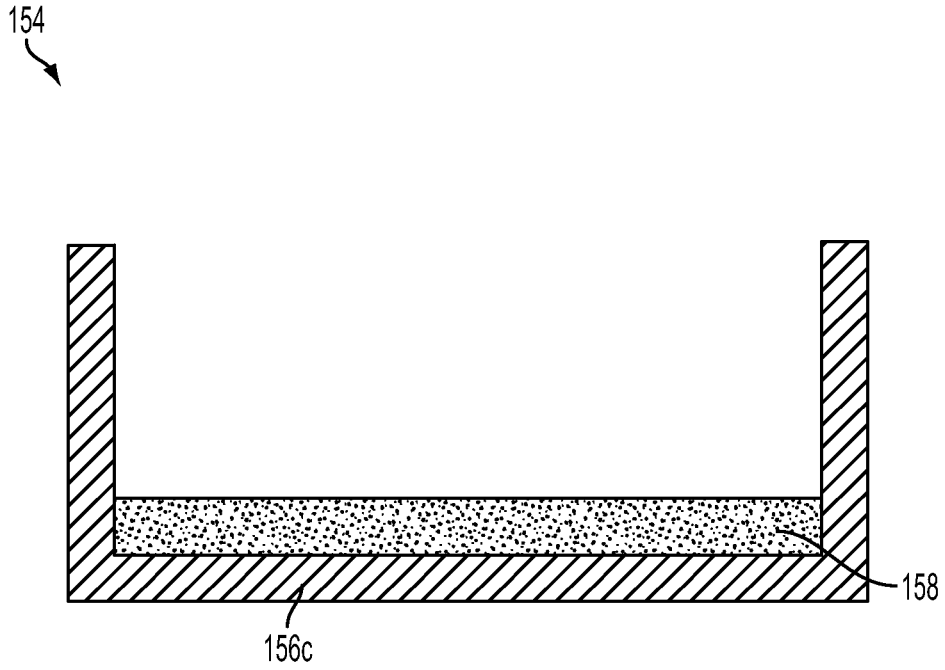
FIG. 15 is a cross-sectional view of a container in a first stage of a process for forming a cutting element.

In some embodiments, the polycrystalline table 116 (see FIG. 2) may be formed by subjecting particles of superhard material to a high temperature/high pressure (HTHP) process, sintering the particles to one another to form the polycrystalline material of the polycrystalline table 116 (see FIG. 2). Such a process may be performed by placing a container in which the particles are located into a press and subjecting the particles to the HTHP process. The HTHP process may also be used to attach the polycrystalline table 116 to a substrate 118 to form a cutting element 112 (see FIG. 2). For example, a cross-sectional view of such a container 154 for forming a cutting element 112 (see FIG. 2) is shown in FIG. 15 in a first stage of a process for forming the cutting element 112 (see FIG. 2). The container 154 may include one or more generally cup-shaped members, such as cup-shaped member 156*c*, which may act as a receptacle. Particles 158 may be placed in the cup-shaped member 156*c*, which may have a circular end wall and a generally cylindrical lateral side wall extending perpendicularly from the circular end wall, such that the cup-shaped member 156*c* is generally cylindrical and includes a first closed end and a second, opposite open end. The particles 158 may include a superhard material in the form of, for example, powdered diamond (e.g., natural, synthetic, or natural and synthetic diamond) or powdered cubic boron nitride, which may optionally be mixed with a liquid (e.g., alcohol) to form a slurry (e.g., a paste). The particles 158 may include a catalyst material (e.g., iron, nickel, or cobalt) selected to catalyze formation of inter-granular bonds between individual particles of the superhard material in some embodiments. The particles 158 may exhibit a monomodal or multimodal (e.g., bimodal, trimodal, etc.) particle size distribution.

Figure 16:
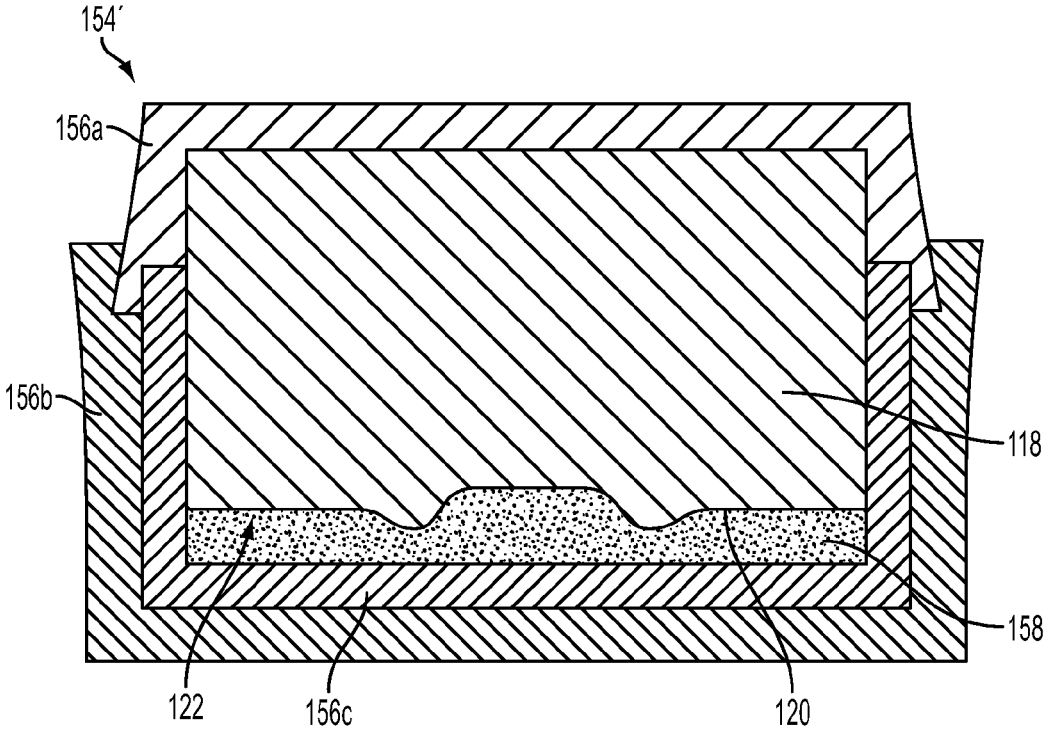
FIG. 16 is a cross-sectional view of the container of FIG. 15 in a second stage of a process for forming a cutting element.

Referring to FIG. 16, a cross-sectional view of the container 154' of FIG. 15 is shown in a second stage of a process for forming a cutting element 112 (see FIG. 2). The container 154' may include the cup-shaped member 156*c* and two additional cup-shaped members 156*a* and 156*b*, which may be assembled and swaged and/or welded together to form the container 154'. A substrate 118 having a non-planar end 122, such as, for example, any of those shown in FIGS. 3 through 14, may be placed in the container 154' with the non-planar end 122 facing the particles 158. In some embodiments, the substrate 118 may be in a green state (i.e., an unsintered state with less than a final density) with hard particles (e.g., tungsten carbide) held in place by a binder material (e.g., wax). In other embodiments, the substrate may be in a brown state (i.e., a sintered state still with less than a final density) with hard particles bound in a matrix material (e.g., a solvent metal catalyst). In still other embodiments, the substrate 118 may be a fully sintered part (e.g., cemented tungsten carbide at a final density). The non-planar end 122 may be pressed against the particles 158 to impart a shape inverse to the shape of the non-planar end 122 to the particles 158. In other embodiments, the substrate 118 may be placed in the container 154' before the particles 158, and the particles 158 may simply conform to the shape of the non-planar end 122 when they are placed adjacent the non-planar end 122 within the container 154'. Assembly of the container 154' may be completed, and the substrate 118 and particles 158 may be subjected to a high temperature/high pressure (HTHP) process to cause the particles 158 to interbond with one another in the presence of catalyst material (e.g., melted to flow among the rest of the particles 158 or swept among the particles 158 from within the substrate 118) to form the polycrystalline table 116 and to secure the polycrystalline table 116 to the substrate 118 at the non-planar interface 120. In embodiments where the substrate 118 has less than a final density, the HTHP process may also sinter the substrate 118 to a final density. Conventional HTHP processing may be used to form the cutting element 112 (see FIG. 2).

Additional, non-limiting embodiments within the scope of the present disclosure include, but are not limited to, the following:

Embodiment 1

A cutting element for an earth-boring tool comprises a substrate, a polycrystalline table comprising superhard material secured to the substrate at an end of the substrate, and a non-planar interface defined between the polycrystalline table and the substrate. The non-planar interface comprises a cross-shaped groove extending into one of the substrate and the polycrystalline table and L-shaped grooves extending into the other of the substrate and the polycrystalline table proximate corners of the cross-shaped groove. Transitions between surfaces defining the non-planar interface are rounded.

Embodiment 2

The cutting element of Embodiment 1, further comprising a tapered surface in an area between arms of each of the L-shaped grooves, the tapered surface extending from an intersect point of each of the L-shaped grooves toward the one of the substrate and the polycrystalline table.

Embodiment 3

The cutting element of Embodiment 2, further comprising concentric grooves extending from each tapered surface into the other of the substrate and the polycrystalline table, wherein the concentric grooves do not intersect with the arms of the L-shaped grooves and a center of curvature of each of the concentric grooves is located at a central axis of the cutting element.

Embodiment 4

The cutting element of Embodiment 2, further comprising a pear-shaped depression extending from each tapered surface into the other of the substrate and the polycrystalline table, wherein an axis of symmetry of the pear-shaped depression bisects an angle defined between the arms of each of the L-shaped grooves.

Embodiment 5

The cutting element of Embodiment 4, wherein a depth of each pear-shaped depression is less than a depth of each of the L-shaped grooves.

Embodiment 6

The cutting element of Embodiment 1, further comprising a curved groove extending between arms of each of the L-shaped grooves into the other of the substrate and the polycrystalline table, wherein a center of curvature of each curved groove is located at a central axis of the cutting element and wherein the curved grooves do not intersect with the arms of the L-shaped grooves.

Embodiment 7

The cutting element of Embodiment 6, wherein a circle defined by connecting outermost points of the arms of the L-shaped grooves also defines an outermost extent of the curved grooves.

Embodiment 8

The cutting element of Embodiment 6 or Embodiment 7, further comprising a trench formed in each curved groove extending into the one of the substrate and the polycrystalline table, wherein the trench follows the curve of each curved groove.

Embodiment 9

The cutting element of any one of Embodiments 1 through 8, wherein a depth of the cross-shaped groove is less than a depth of each of the L-shaped grooves.

Embodiment 10

The cutting element of any one of Embodiments 1 through 9, wherein the transitions between the surfaces defining the non-planar interface have a radius of curvature of at least 0.25 mm.

Embodiment 11

An earth-boring tool comprises a body and cutting elements secured to the body. At least one of the cutting elements comprises a substrate, a polycrystalline table comprising superhard material secured to the substrate at an end of the substrate, and a non-planar interface defined between the polycrystalline table and the substrate. The non-planar interface comprises a cross-shaped groove extending into one of the substrate and the polycrystalline table and L-shaped grooves extending into the other of the substrate and the polycrystalline table proximate corners of the cross-shaped groove. Transitions between surfaces defining the non-planar interface are rounded.

Embodiment 12

A method of forming a cutting element for an earth-boring tool comprises forming a substrate to have a non-planar end. The non-planar end comprises a cross-shaped groove extending into the substrate and L-shaped protrusions extending from a remainder of the substrate proximate corners of the cross-shaped groove. Transitions between surfaces defining the non-planar end are shaped to be rounded. Particles of superhard material are positioned adjacent the non-planar end of the substrate in a container. The particles are sintered in a presence of a catalyst material to form a polycrystalline table secured to the substrate, with a non-planar interface being defined between the substrate and the polycrystalline table.

Embodiment 13

The method of Embodiment 12, further comprising forming the non-planar end to comprise a tapered surface in an area between arms of each of the L-shaped grooves, the tapered surface extending from an intersect point of each of the L-shaped grooves toward the remainder of the substrate.

Embodiment 14

The method of Embodiment 13, further comprising forming the non-planar end to comprise concentric protrusions extending from each tapered surface away from the remainder of the substrate, wherein the concentric protrusions do not intersect with the arms of the L-shaped protrusions and a center of curvature of each of the concentric protrusions is located at a central axis of the substrate.

Embodiment 15

The method of Embodiment 13, further comprising forming the non-planar end to comprise a pear-shaped protrusion extending from each tapered surface away from the remainder of the substrate, wherein an axis of symmetry of the pear-shaped protrusion bisects an angle defined between the arms of each of the L-shaped protrusions.

Embodiment 16

The method of Embodiment 12, further comprising forming the non-planar end to comprise a curved protrusion extending between arms of each of the L-shaped protrusions into the substrate, wherein a center of curvature of each curved protrusion is located at a central axis of the substrate and wherein the curved protrusions do not intersect with the arms of the L-shaped protrusions.

Embodiment 17

The method of Embodiment 16, wherein forming the non-planar end to comprise the curved protrusion extending between the arms of each of the L-shaped protrusions comprises forming an outermost extent of each curved protrusion to coincide with a circle defined by connecting outermost points of the arms of the L-shaped protrusions.

Embodiment 18

The method of Embodiment 16 or Embodiment 17, further comprising forming the non-planar end to comprise a trench extending toward the substrate formed in each curved protrusion, wherein the trench follows the curve of each curved protrusion.

Embodiment 19

The method of any one of Embodiments 12 through 18, further comprising forming a depth of the cross-shaped groove to be less than a height of each of the L-shaped protrusions.

Embodiment 20

The cutting element of any one of Embodiments 12 through 18, further comprising pressing the non-planar end of the substrate against the particles to impart an inverse shape of the non-planar end to the particles.

While certain illustrative embodiments have been described in connection with the figures, those of ordinary skill in the art will recognize and appreciate that the scope of the disclosure is not limited to those embodiments explicitly shown and described herein. Rather, many additions, deletions, and modifications to the embodiments described herein may be made to produce embodiments within the scope of the disclosure, such as those hereinafter claimed, including legal equivalents. In addition, features from one disclosed embodiment may be combined with features of another disclosed embodiment while still being within the scope of the disclosure, as contemplated by the inventors.

What is claimed is:

1. A cutting element for an earth-boring tool, comprising:

a substrate;

a polycrystalline table comprising superhard material secured to the substrate at an end of the substrate; and a non-planar interface defined between the polycrystalline table and the substrate, the non-planar interface comprising a cross-shaped groove extending into one of the substrate and the polycrystalline table to a first maximum elevation of the non-planar interface along a central axis of the substrate, an intersection between arms of the cross-shaped groove being aligned with the central axis of the substrate, and L-shaped grooves extending into the other of the substrate and the polycrystalline table proximate corners of the cross-shaped groove to a second, opposing maximum elevation of the non-planar interface along the central axis of the substrate, each L-shaped groove being defined by intersecting arms, the arms separating a surface of the non-planar interface from the cross-shaped groove, wherein an elevation of the surface along the central axis of the substrate is between the first maximum elevation to which the cross-shaped groove extends and the second maximum elevation to which the L-shaped grooves extend, and wherein transitions between surfaces defining the non-planar interface are rounded.

2. The cutting element of claim 1, further comprising each surface of the non-planar interface separated from the cross-shaped groove by the L-shaped grooves to be a tapered surface, the tapered surface extending from an intersect point of each of the L-shaped grooves toward the one of the substrate and the polycrystalline table.

3. The cutting element of claim 2, further comprising concentric grooves extending from each tapered surface into the other of the substrate and the polycrystalline table, wherein the concentric grooves do not intersect with the arms of the L-shaped grooves and a center of curvature of each of the concentric grooves is located at a central axis of the cutting element.

4. The cutting element of claim 2, further comprising a pear-shaped depression extending from each tapered surface into the other of the substrate and the polycrystalline table, wherein an axis of symmetry of the pear-shaped depression bisects an angle defined between the arms of each of the L-shaped grooves.

5. The cutting element of claim 4, wherein a depth of each pear-shaped depression is less than a depth of each of the L-shaped grooves.

6. The cutting element of claim 1, further comprising a curved groove extending between arms of each of the L-shaped grooves into the other of the substrate and the polycrystalline table, wherein a center of curvature of each curved groove is located at a central axis of the cutting element and wherein the curved grooves do not intersect with the arms of the L-shaped grooves.

7. The cutting element of claim 6, wherein a circle defined by connecting outermost points of the arms of the L-shaped grooves also defines an outermost extent of the curved grooves.

8. The cutting element of claim 6, further comprising a trench formed in each curved groove extending into the one of the substrate and the polycrystalline table, wherein the trench follows the curve of each curved groove.

9. The cutting element of claim 1, wherein a greatest depth of the cross-shaped groove is less than a depth of each of the L-shaped grooves.

10. The cutting element of claim 1, wherein the transitions between the surfaces defining the non-planar interface have a radius of curvature of at least 0.25 mm.

11. An earth-boring tool, comprising:

a body; and cutting elements secured to the body, at least one of the cutting elements comprising:

a substrate;

a polycrystalline table comprising superhard material secured to the substrate at an end of the substrate; and a non-planar interface defined between the polycrystalline table and the substrate, the non-planar interface comprising a cross-shaped groove extending into one of the substrate and the polycrystalline table to a first maximum elevation of the non-planar interface along a central axis of the substrate, an intersection between arms of the cross-shaped groove being aligned with the central axis of the substrate, and L-shaped grooves extending into the other of the substrate and the polycrystalline table proximate corners of the cross-shaped groove to a second, opposing maximum elevation of the non-planar interface along the central axis of the substrate, each L-shaped groove being defined by intersecting arms, the arms separating a surface of the non-planar interface from the cross-shaped groove, wherein an elevation of the surface along the central axis of the substrate is between the first maximum elevation to which the cross-shaped groove extends and the second maximum elevation to which the L-shaped grooves extend, and wherein transitions between surfaces defining the non-planar interface are rounded.

12. A method of forming a cutting element for an earth-boring tool, comprising:

forming a substrate to have a non-planar end, the non-planar end comprising a cross-shaped groove extending into the substrate to a first maximum elevation of the non-planar interface along a central axis of the substrate, an intersection between arms of the cross-shaped groove being aligned with the central axis of the substrate, and L-shaped protrusions extending from a remainder of the substrate proximate corners of the cross-shaped groove to a second, opposing maximum elevation of the non-planar interface along the central axis of the substrate, each L-shaped groove being defined by intersecting arms, the arms separating a surface of the non-planar interface from the cross-shaped groove, wherein an elevation of the surface along the central axis of the substrate is between the first maximum elevation to which the cross-shaped groove extends and the second maximum elevation to which the L-shaped grooves extend;

shaping transitions between surfaces defining the non-planar end to be rounded;

positioning particles of superhard material adjacent the non-planar end of the substrate in a container; and sintering the particles in a presence of a catalyst material to form a polycrystalline table secured to the substrate, with a non-planar interface being defined between the substrate and the polycrystalline table.

13. The method of claim 12, further comprising forming each surface of the non-planar interface separated from the cross-shaped groove by the L-shaped grooves to comprise a tapered surface in an area between the arms of each of the L-shaped grooves, the tapered surface extending from an intersect point of each of the L-shaped grooves toward the remainder of the substrate.

14. The method of claim 13, further comprising forming the non-planar end to comprise concentric protrusions extending from each tapered surface away from the remainder of the substrate, wherein the concentric protrusions do not intersect with the arms of the L-shaped protrusions and a center of curvature of each of the concentric protrusions is located at a central axis of the substrate.

15. The method of claim 13, further comprising forming the non-planar end to comprise a pear-shaped protrusion extending from each tapered surface away from the remainder of the substrate, wherein an axis of symmetry of the pear-shaped protrusion bisects an angle defined between the arms of each of the L-shaped protrusions.

16. The method of claim 12, further comprising forming the non-planar end to comprise a curved protrusion extending between the arms of each of the L-shaped protrusions into the substrate, wherein a center of curvature of each curved protrusion is located at a central axis of the substrate and wherein the curved protrusions do not intersect with the arms of the L-shaped protrusions.

17. The method of claim 16, wherein forming the non-planar end to comprise the curved protrusion extending between the arms of each of the L-shaped protrusions comprises forming an outermost extent of each curved protrusion to coincide with a circle defined by connecting outermost points of the arms of the L-shaped protrusions.

18. The method of claim 16, further comprising forming the non-planar end to comprise a trench extending toward the substrate formed in each curved protrusion, wherein the trench follows the curve of each curved protrusion.

19. The method of claim 12, further comprising forming a greatest depth of the cross-shaped groove to be less than a height of each of the L-shaped protrusions.

20. The cutting element of claim 12, further comprising pressing the non-planar end of the substrate against the particles to impart an inverse shape of the non-planar end to the particles.

* * * * *